US009980547B2

(12) United States Patent
Brown, Jr. et al.

(10) Patent No.: US 9,980,547 B2
(45) Date of Patent: May 29, 2018

(54) WRITING INSTRUMENT CASE

(71) Applicant: SANFORD L.P., Downers Grove, IL (US)

(72) Inventors: Prince Earl Brown, Jr., Oak Forest, IL (US); Daniel Francis Debartolo, Jr., Chicago, IL (US); Eliott Guy Copier, Grand Rapids, MI (US); Ejung Kim, Kalamazoo, MI (US); Mark Alan Zavada, Kalamazoo, MI (US); Stefaan Van Den Broecke, Kalamazoo, MI (US)

(73) Assignee: SANFORD, L.P., Atlanta, GA (US)

( * ) Notice: Subject to any disclaimer, the term of this patent is extended or adjusted under 35 U.S.C. 154(b) by 0 days. days.

(21) Appl. No.: 15/240,367

(22) Filed: Aug. 18, 2016

(65) Prior Publication Data

US 2017/0245611 A1 Aug. 31, 2017

Related U.S. Application Data

(60) Provisional application No. 62/301,353, filed on Feb. 29, 2016.

(51) Int. Cl.
*A45C 11/34* (2006.01)
*A45C 11/36* (2006.01)

(52) U.S. Cl.
CPC ..... *A45C 11/34* (2013.01); *A45C 11/36* (2013.01)

(58) Field of Classification Search
CPC ..... A45C 11/34; A45C 11/36; B65D 5/52; B65D 43/16
USPC ..... 206/45.2, 45.23, 214, 224, 371, 443
See application file for complete search history.

(56) References Cited

U.S. PATENT DOCUMENTS

| | | | | |
|---|---|---|---|---|
| 1,879,029 | A * | 9/1932 | Baumgard | B65D 5/5206 206/45.21 |
| 5,186,320 | A * | 2/1993 | Aida | A45C 11/34 206/214 |
| 5,248,030 | A * | 9/1993 | Tarozzi | A45C 11/36 206/214 |
| 6,029,816 | A * | 2/2000 | Goodwin | A45C 11/34 206/214 |
| 6,364,100 | B1 | 4/2002 | Leibeck | |
| 6,681,933 | B1 * | 1/2004 | Demsien | A45C 11/34 206/214 |

(Continued)

FOREIGN PATENT DOCUMENTS

| | | | | |
|---|---|---|---|---|
| DE | 10250599 | A1 * | 5/2004 | A45C 11/34 |

*Primary Examiner* — Bryon Gehman
(74) *Attorney, Agent, or Firm* — Marshall, Gerstein & Borun LLP

(57) ABSTRACT

A writing instrument case includes a base having a first member and a second member rotatably attached to the first member via a hinge. A flap is attached to the base and includes at least one button adapted to fit within at least one dimple of the second member. The flap further includes a plurality of grooves, at least one groove having a knob to secure a portion of a writing instrument to the flap. The second member of the base is rotatably moveable between a closed position, in which the flap fits within the second member of the base, and an open position, in which the projection of the second member fits into the slot of the first member of the base upon rotation of the second member toward the first member, forming a locking mechanism.

20 Claims, 27 Drawing Sheets

(56) References Cited

U.S. PATENT DOCUMENTS

2012/0193261 A1* 8/2012 Begim ..... B65D 81/113
206/521

* cited by examiner

WRITING INSTRUMENT CASE

FIELD OF THE DISCLOSURE

The present disclosure relates generally to cases for writing instruments, and, in particular, to a writing instrument case having a locked easel position.

BACKGROUND OF THE DISCLOSURE

Various cases for writing instruments, such as pens, markers, and mechanical pencils, are well known. Some cases include an easel that allows the case to stand during use. This can ease access to, removal of, and return of the writing instruments to the case. Such easels, however, are typically made of a perforated packaging case, and, therefore, are often not rigid and strong enough to withstand the weight of writing instruments for a desired amount of time, or even at all while in an easel position. In addition, many cases do not adequately hold the writing instruments in their intended positions within the case during use and/or transport. For example, markers and pens often move out of their intended positions within the case during use, disrupting the marker and pen organization in an easel position, for example. In other case designs, the writing instruments are needed to keep the case in a standing position, such as a standing easel position. This presents difficulties during use of the writing instruments because, as they are removed from the case, the standing position is often interrupted or even completely destroyed.

SUMMARY OF THE DISCLOSURE

In accordance with an exemplary aspect of the disclosure, a writing instrument case can include a base with a first member and a second member rotatably attached to the first member via a living hinge. The first member has a rear surface with a slot. The second member has at least one dimple and a rear surface with a projection adapted to fit within the slot of the first member upon rotation of the second member in a direction toward the first member. In addition, a flap is attached to the base and includes at least one button adapted to fit within the at least one dimple of the second member. The flap also includes an inside surface having a plurality of channels adapted to receive at least one writing instrument, and an outside surface having a plurality of grooves aligned with the plurality of channels. The at least one groove is adapted to receive a portion of a cap of the at least one writing instrument, and the at least one groove includes a knob.

The second member of the base is rotatably moveable between a closed position, in which the at least one button of the flap is disposed within the dimple of the second member, and an open position. In the open position, the at least one button is removed from the dimple of the second member and the second member is rotated about the hinge until the projection of the second member fits within the slot of the first member of the base, forming a locking mechanism between the first and second members and creating a locked easel position.

According to another exemplary aspect of the present disclosure, a writing instrument case includes a base with a first member and a second member rotatably attached to the first member via a hinge. The first member has a receiving portion, and the second member has a projecting portion adapted to be inserted into the receiving portion. A flap is permanently attached to the first member of the base and has at least one groove adapted to receive a portion of at least one writing instrument. The at least one groove has a knob.

The second member of the base is rotatably moveable between a closed position, in which the second member engages a portion of the flap, and an easel position. In the easel position, the second member is removed from the portion of the flap and rotated about the hinge until the projecting portion of the second member fits within the receiving portion of the first member of the base, forming a locking mechanism between the first and second members.

In further accordance with any one or more of the exemplary aspects, the writing instrument case of the present disclosure may include any one or more of the following further embodiments.

In some embodiments, the rear surface of the first member of the base further includes a wedge, and the slot is disposed within the wedge.

In some other embodiments, the rear surface of the second member of the base further includes a wedge having a geometric configuration that matches the geometric configuration of the wedge of the first member of the base. In addition, the projection is disposed on the wedge of the second member.

In some embodiments, when the second member of the base is in the open position, a surface of the wedge of the first member contacts a surface of the wedge of the second member. In addition, the projection of the second member fits into the slot of the first member to form the locking mechanism in the easel position.

In other embodiments, the second member of the base of the writing instrument case includes a pair of side walls. Each side wall of the pair of side walls includes a dimple adapted to receive a button of the flap.

In still other embodiments, the first member of the base of the writing instrument case includes a pair of side walls and a bottom portion. Each side wall of the pair of side walls and the bottom portion include at least one opening adapted to receive at least one tab of the flap to permanently attach the flap to the first member of the base.

In other embodiments, the flap includes a pair of side walls and a bottom portion, and each of the side walls and the bottom portion have at least one tab adapted to fit within at least one opening of the first member of the base.

In some embodiments, the plurality of channels of the inside surface of the flap include at least one channel having a diameter that decreases along the length of the channel.

In still other embodiments, each groove of the plurality of grooves disposed on the outside surface of the flap includes a knob to help secure the writing instrument to the flap.

In yet other embodiments, the second member of the base of the writing instrument case is rotated about the hinge in a clockwise direction until the projection of the second member of the base fits into the slot of the first member of the base to form the locking mechanism.

In other embodiments, one or more of the base and the flap are made of one or more of a polypropylene material, a homopolymer material, a plastic material, or any other rigid material having a strength to support the at least one writing instrument disposed within the case in the easel position.

In some embodiments, the receiving portion is one or more of an aperture, a slot, or an opening disposed within the rear surface of the first member. In addition, the projecting portion is at least one projection extending from a rear surface of the second member.

Additional optional aspects and features are disclosed, which may be arranged in any functionally appropriate manner, either alone or in any functionally viable combination, consistent with the teachings of the disclosure. Other aspects and advantages will become apparent upon consideration of the following detailed description.

BRIEF DESCRIPTION OF THE DRAWINGS

The Figures described below depict various aspects of the system and methods disclosed therein. It should be understood that each figure depicts an example of a particular aspect of the disclosed system and methods, and that each of the figures is intended to accord with a possible example thereof. Further, wherever possible, the following description refers to the reference numerals included in the following figures, in which features depicted in multiple figures are designated with consistent reference numerals.

There are shown in the drawings arrangements which are presently discussed, it being understood, however, that the present examples are not limited to the precise arrangements and instrumentalities shown, wherein.

DETAILED DESCRIPTION OF THE DISCLOSURE

Generally, a writing instrument case is disclosed. The writing instrument case can include a base with a first member and a second member rotatably attached to the first member via a single living hinge. The first member can include a receiving portion, and the second member can have a projecting portion adapted to be inserted into the receiving portion in an easel position. A flap can be attached to the base and includes at least one groove adapted to receive a portion of at least one writing instrument. The at least one groove can include a knob that further secures the at least one writing instrument, preventing the writing instrument from moving out of an intended position in any orientation of the case.

Figure 14:
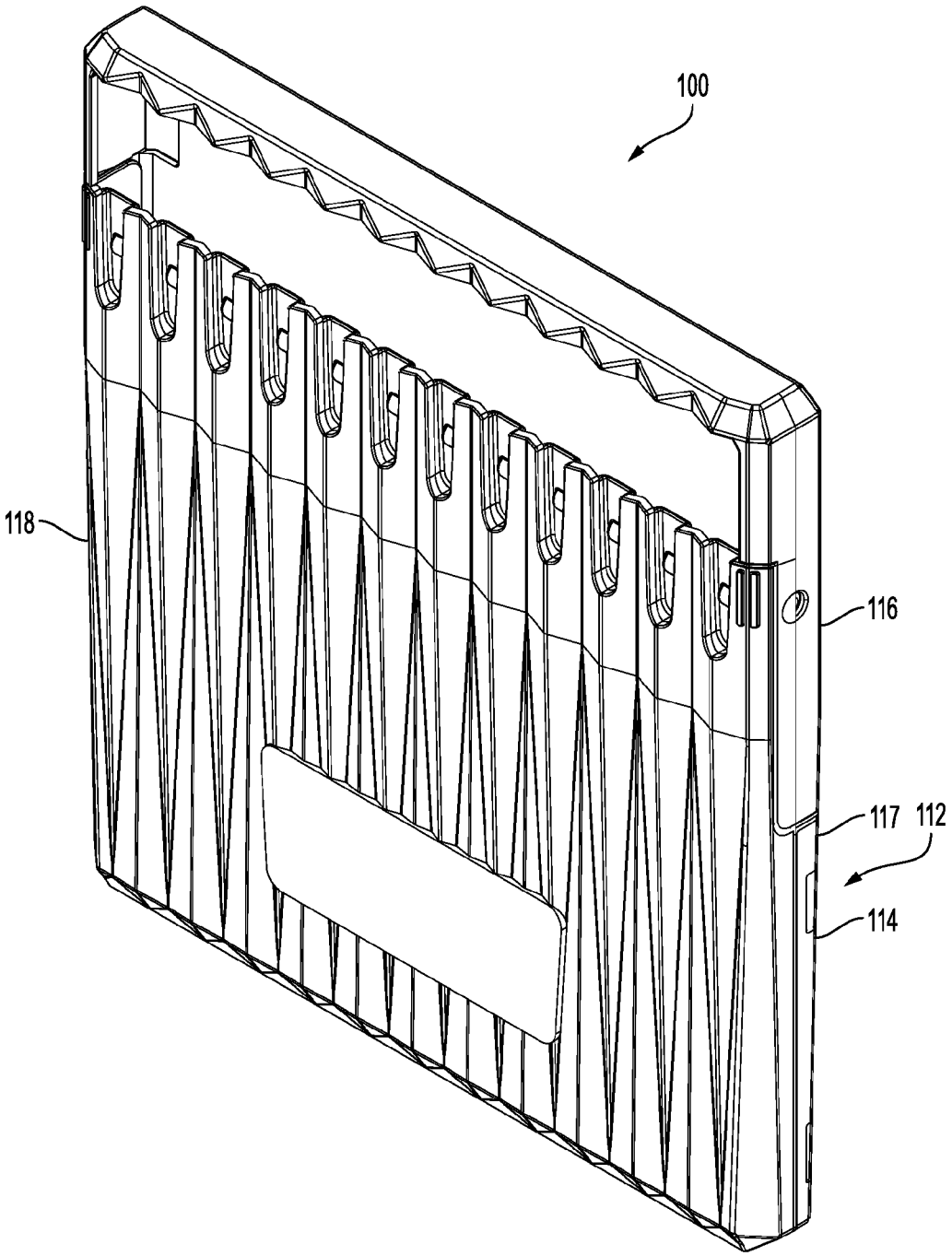
FIG. 14 is a front perspective view of a writing instrument case in accordance with an embodiment of the disclosure, the writing instrument case in a closed position.
Figure 17:
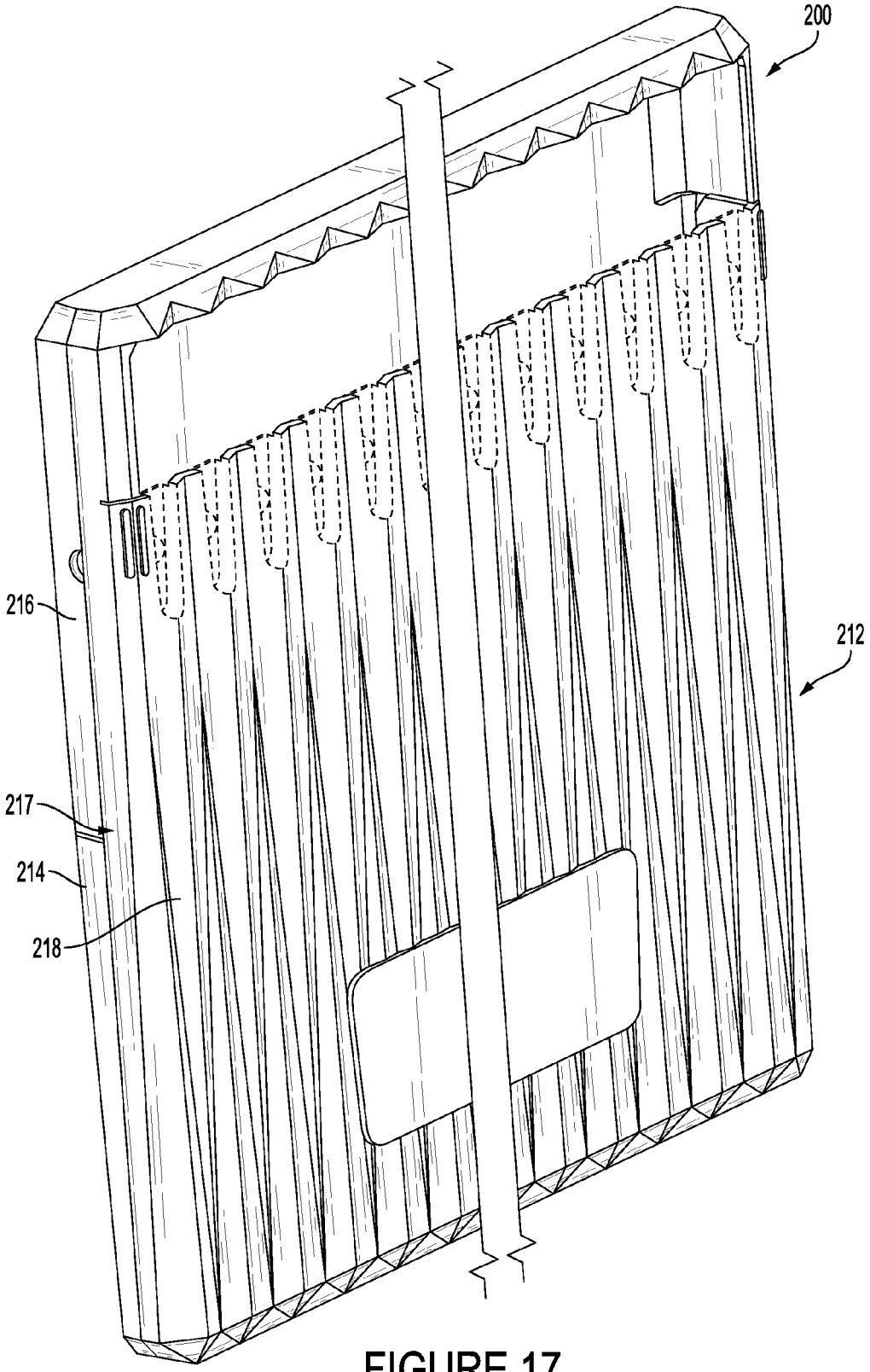
FIG. 17 is a front perspective view of a writing instrument case in accordance with an embodiment of the disclosure, the writing instrument case being in the closed position.
Figure 18:
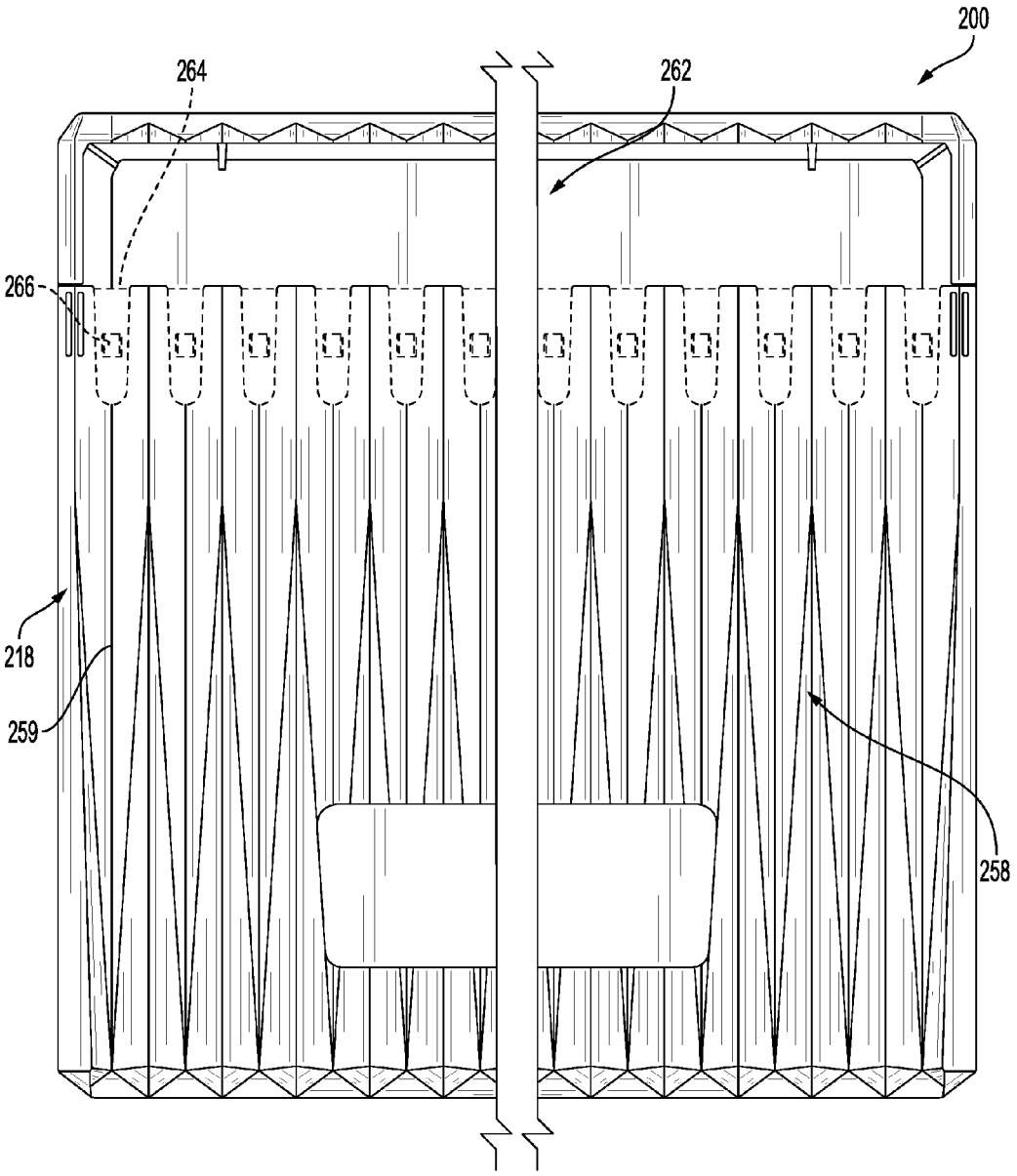
FIG. 18 is a front view of the writing instrument case of FIG. 17.
Figure 19:
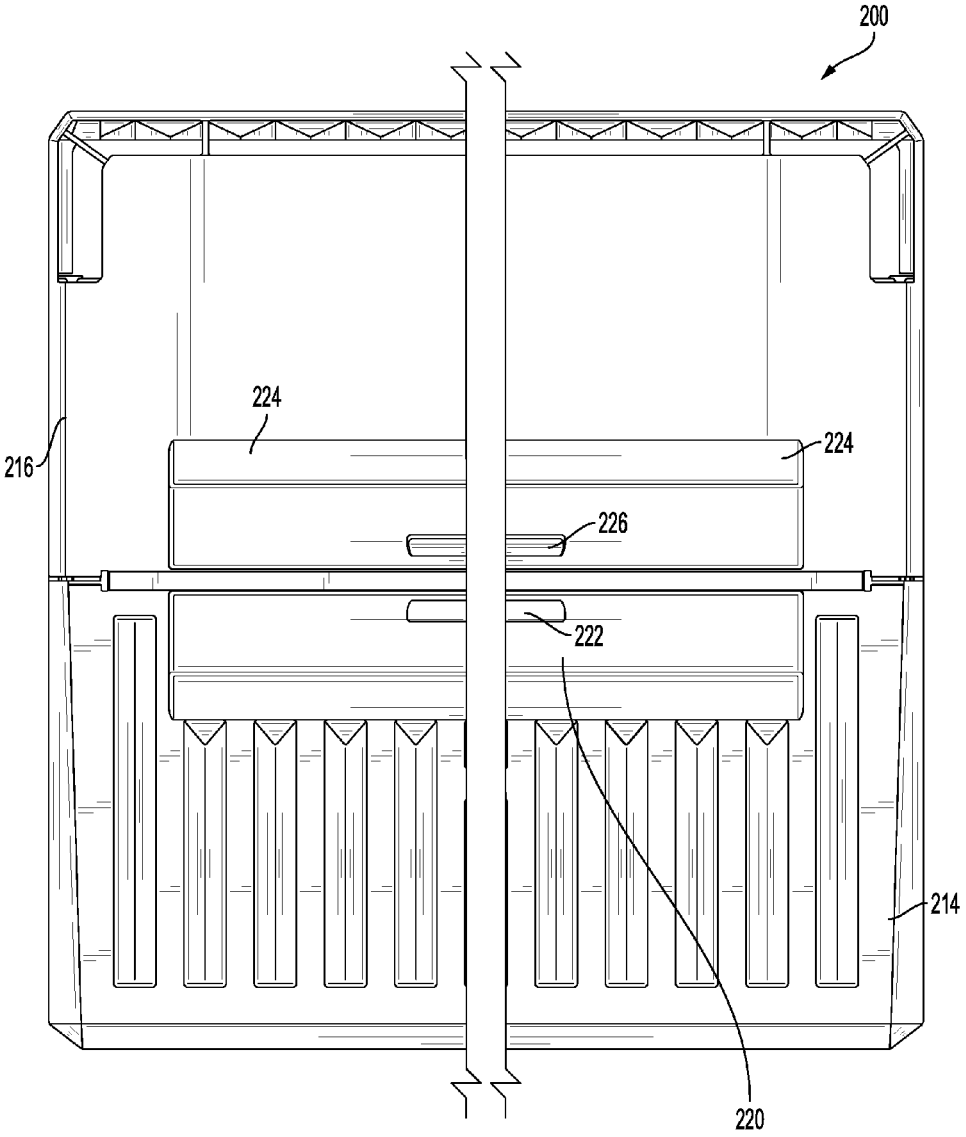
FIG. 19 is a rear view of the writing instrument case of FIG. 17.
Figure 20:
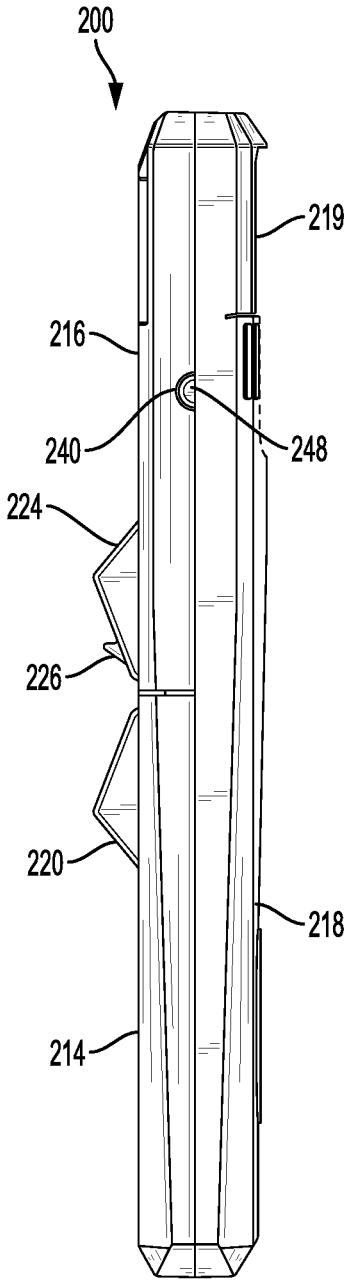
FIGS. 20 and 21 are side views of the writing instrument case of FIG. 17.
Figure 21:
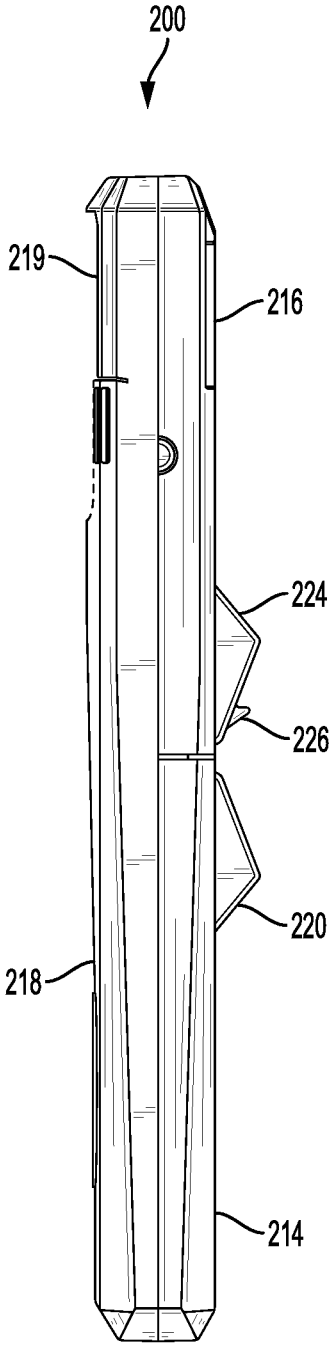
Figure 22:
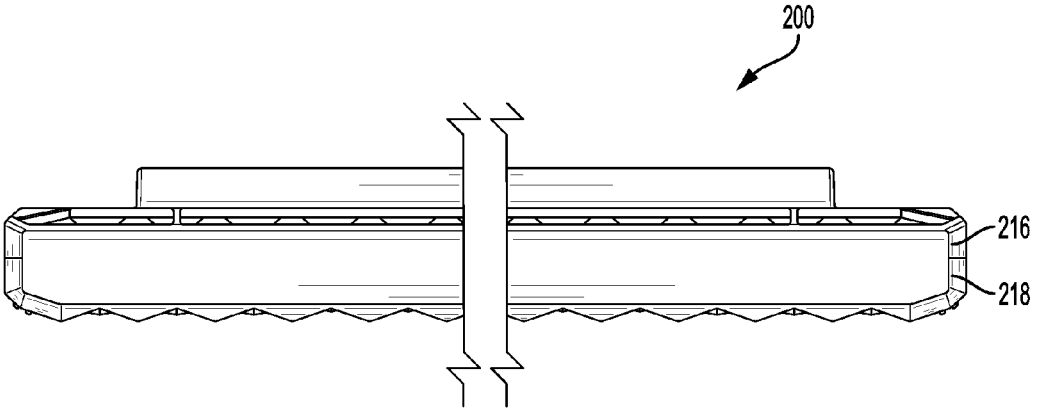
FIG. 22 is a top view of the writing instrument case of FIG. 17.

The second member of the base is rotatably moveable between a closed position, in which a portion of the flap is disposed within the second member, and an open, easel position. In the open, easel position, the second member can be removed from the portion of the flap and rotated about the hinge until the projection portion of the second member fits into the receiving portion of the first member of the base, forming a locking mechanism between the first and second members. As illustrated in FIG. 17, the writing instrument case can have any suitable width and be designed to hold any suitable number of writing instruments. For example, FIG. 1 illustrates an 8 count case having receiving areas for 8 writing instruments, while FIG. 14 illustrates a 12 count case having receiving areas for 12 writing instruments.

Figure 1:
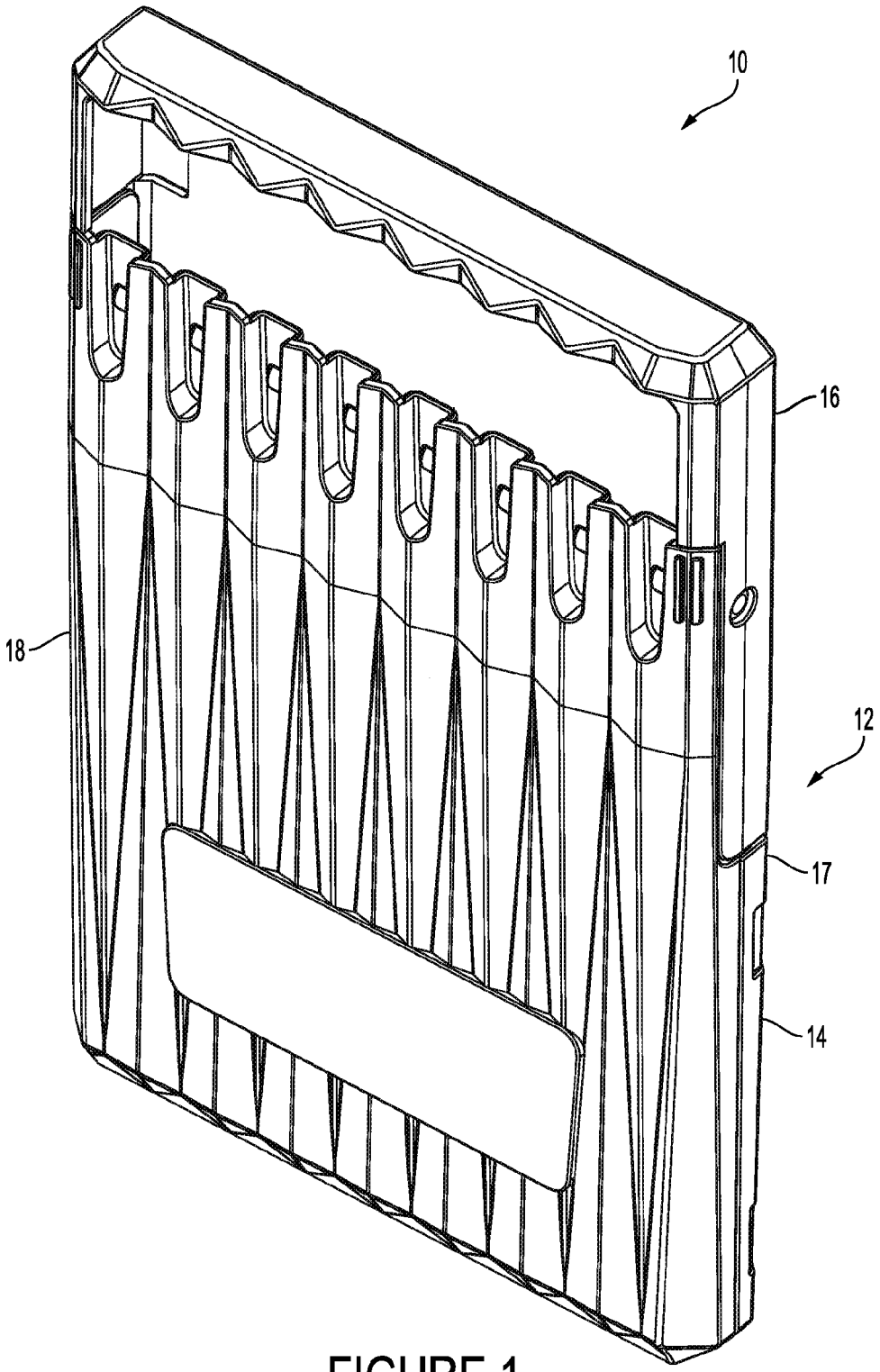
FIG. 1 is a front perspective view of a writing instrument case in accordance with an embodiment of the disclosure, the writing instrument case in a closed position.

Referring now to FIG. 1, in accordance with an embodiment of the disclosure, a writing instrument case 10 includes a base 12 having a first member 14 and a second member 16 rotatably attached to the first member 14 via a hinge 17. In an embodiment, the hinge 17 is a living hinge, which is also known as an integral hinge or a molded hinge. The living hinge 17 can include, for example, thin, flexible webs that connect the rigid first and second members 14, 16 of the base 12. In one example, the living hinge 17 is made of polypropylene. The living hinges can be injection molded, extruded or produced downstream via machining or stamping, for example. The living hinge 17 is an exemplary only, and it will be understood that various other types of hinges can alternatively be used and still fall within the scope of the present disclosure.

The writing instrument case 10 further includes a flap 18 that is attached to a front portion 19 of the base 12. FIGS.

1-3 depict the case 10 in a closed position. Said another way, in the closed position, the flap 18 is disposed within the second member 16, as explained more below.

Figure 2:
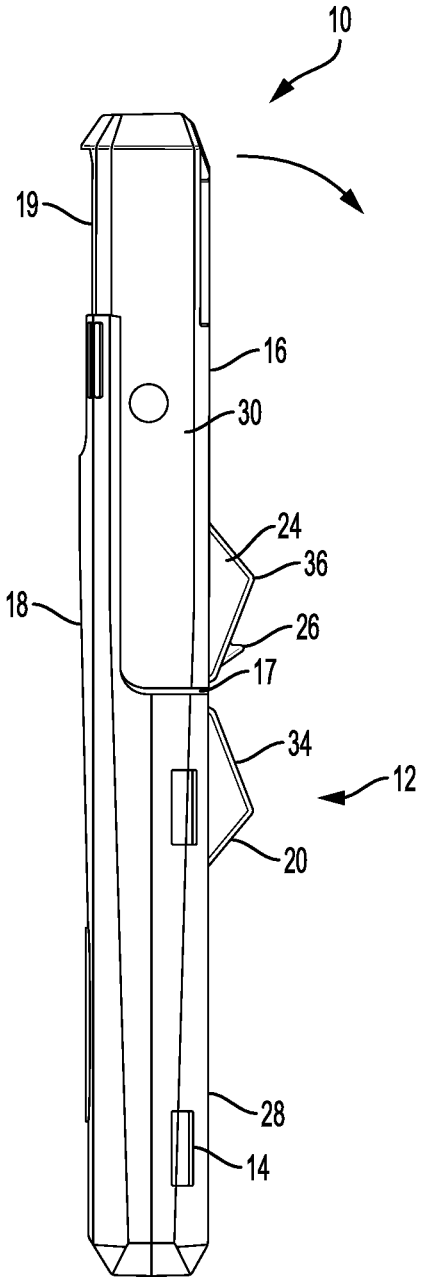
FIG. 2 is a side view of the writing instrument case of FIG. 1.
Figure 3:
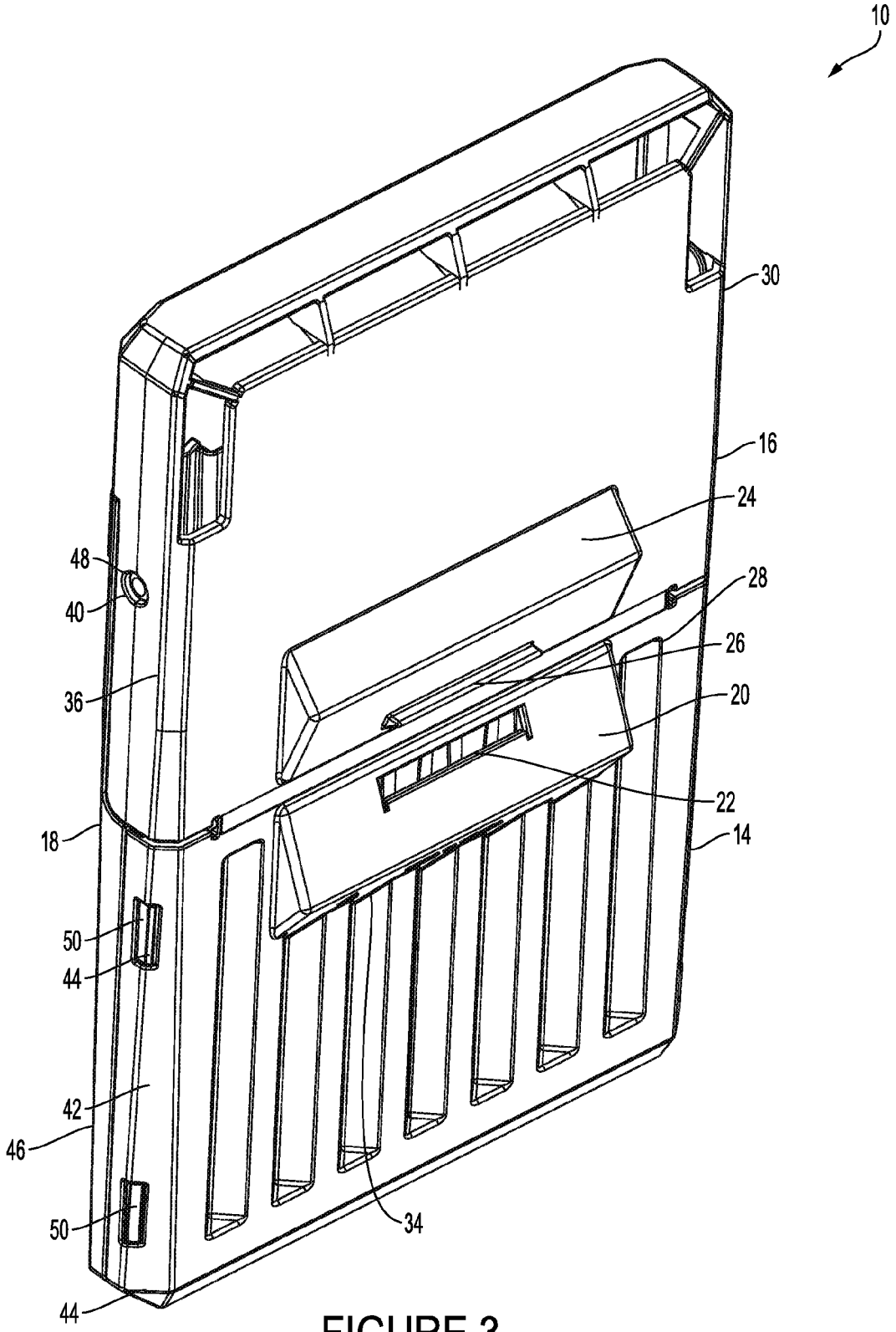
FIG. 3 is a rear perspective view of the writing instrument case of FIG. 1.

As depicted in FIGS. 2 and 3, in an embodiment, the first member 14 includes a wedge 20 having a receiving portion 22 (FIG. 3), such as one or more of an aperture, a slot, or an opening. The second member 16 can also include a wedge 24 having a projecting portion 26 adapted to be inserted into the receiving portion 22 of the first member 14 in one or more of an open position or an easel position, as explained more below. In one example, the first member 14 includes a rear surface 28 having a slot 22 as the receiving portion 22, and the second member 16 includes a rear surface 30 having a projection 26 as the projecting portion 26. As depicted in FIG. 3, the projection 26 can be rectangular in shape and the slot 22 can also be rectangular in shape, allowing easy insertion of the projection 26 into the slot 22 in the easel position. While the slot 22 and the projection 26 are depicted as rectangular in shape in FIG. 3, for example, one of ordinary skill in the art will understand that both the slot 22 and the projection 26 can alternatively and/or additionally be various other shapes, such as one or more of circular, triangular, spherical, or semi-spherical in shape, and still fall within the scope of the present disclosure.

In addition, the wedge 20 of the first member 14 and the wedge 24 of the second member 16 can have matching geometric configurations, which helps provide alignment of the projection 26 of the second member 16 with the slot 22 of the first member 14 of the base, for example. More specifically, and in one example, the wedge 20 has a triangular configuration, and the wedge 24 of the second member 16 likewise has a matching triangular configuration. As one of ordinary skill in the art will further appreciate, the geometric configuration of each of wedges 20, 22 can alternatively and/or additionally be various other shapes and still fall within the scope of the present disclosure. In addition, the wedge 20 of the first member 14 includes an outside surface 34 that contacts an outside surface 36 of the wedge 24 of the second member 16 in the easel position.

Figure 4A:
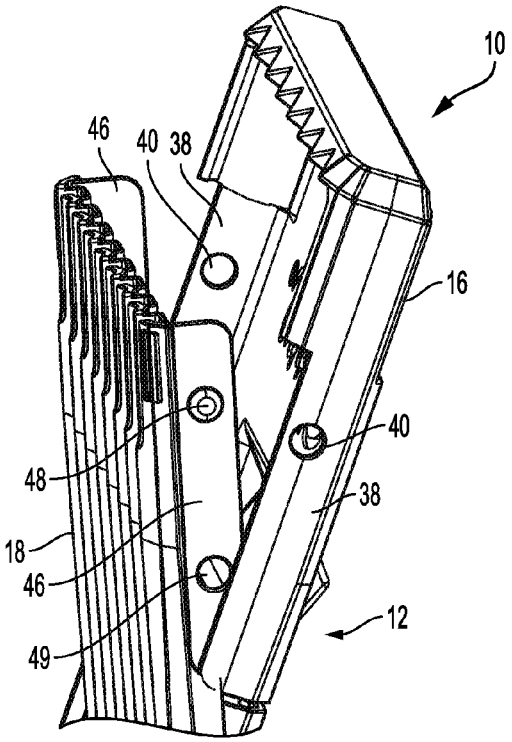
FIG. 4A is a perspective view of the writing instrument case of FIG. 1, the writing instrument case in a partially open position.
Figure 4B:
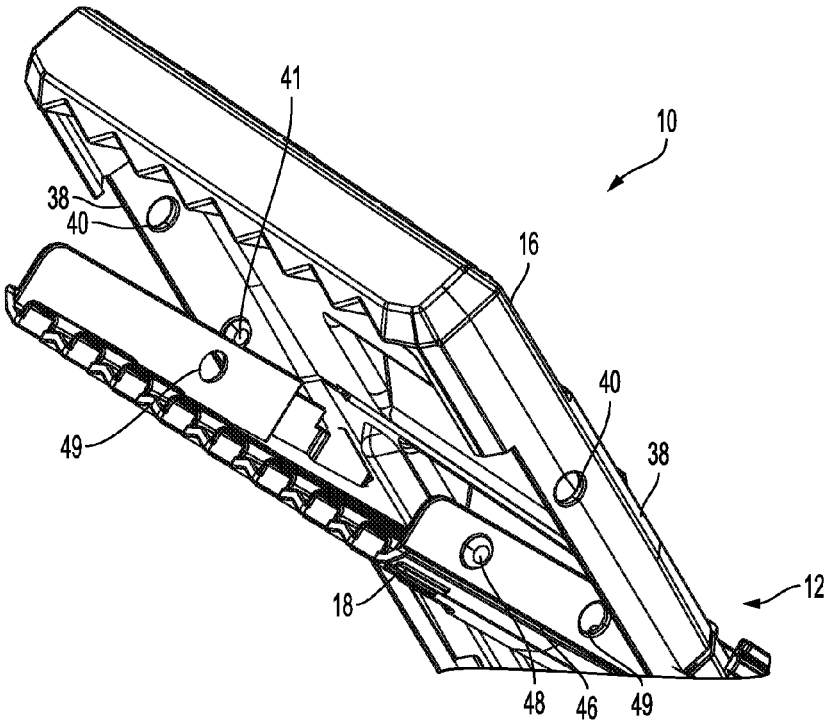
FIG. 4B is another perspective view of the writing instrument case of FIG. 1, the writing instrument case in a partially open position.

Referring now to FIGS. 4A and 4B, the second member 16 of the base 12 is depicted in a partially-open position for illustrative purposes. Said another way, in both FIGS. 4A and 4B, the second member 16 is partially moved away from the flap 18 to illustrate portions of both the second member 16 and the flap 18. More specifically, the second member 16 of the base 12 includes a pair of side walls 38, and each side wall can include at least one dimple 40. Likewise, the flap 18 can include a pair of side walls 46 that fit within the side walls 38 of the second member 16 of the base 12 in a closed position of the second member 16, e.g., when the case 10 is in a closed position, as depicted in FIG. 1, for example. More specifically each side wall 46 of the flap 18 can include at least one button 48 adapted to fit within dimple 40 of the side wall 38 of the second member 16 to removably secure the second member 16 to the flap 18.

The two dimples 40 disposed on the side walls 38 of the second member 16 can in some embodiments add strength and rigidity to the case 10 and/or can provide a clean design that does not detract from the overall design of the case 10. In addition, the dimples 40 can allow for any adjustments, if needed, as to how much force is required to remove the second member 16 from the flap 18, e.g., move the second member 16 from a closed position to a partially open position, for example. In one example, the radius of the dimple is increased or decreased to adjust how much resistance is needed to open and close the case 10, e.g., remove the second member 16 from the flap 18 to move the second member to an open position or an easel position.

In addition, and as further depicted in FIG. 4B, in another example the side walls 38 of the second member 16 include at least one button 41 disposed below the dimples 40 on an inside surface of the side walls 38. Further, in various embodiments, the side walls 46 of the flap 18 include at least one dimple 49 disposed below the buttons 48. Similar to the dimples 40 of the second member 16 that receive the buttons 48 of the flap 18 in the closed position, the at least one dimple 41 disposed on the side wall 38 of the second member 16 fits into a corresponding dimple 49 disposed on the flap 18 when the flap 18 is inserted into the second member 16 of the base. This additional configuration further helps removably secure the flap 18 to the second member 16 in the closed position, providing additional strength and rigidity to the case 10.

Figure 5:
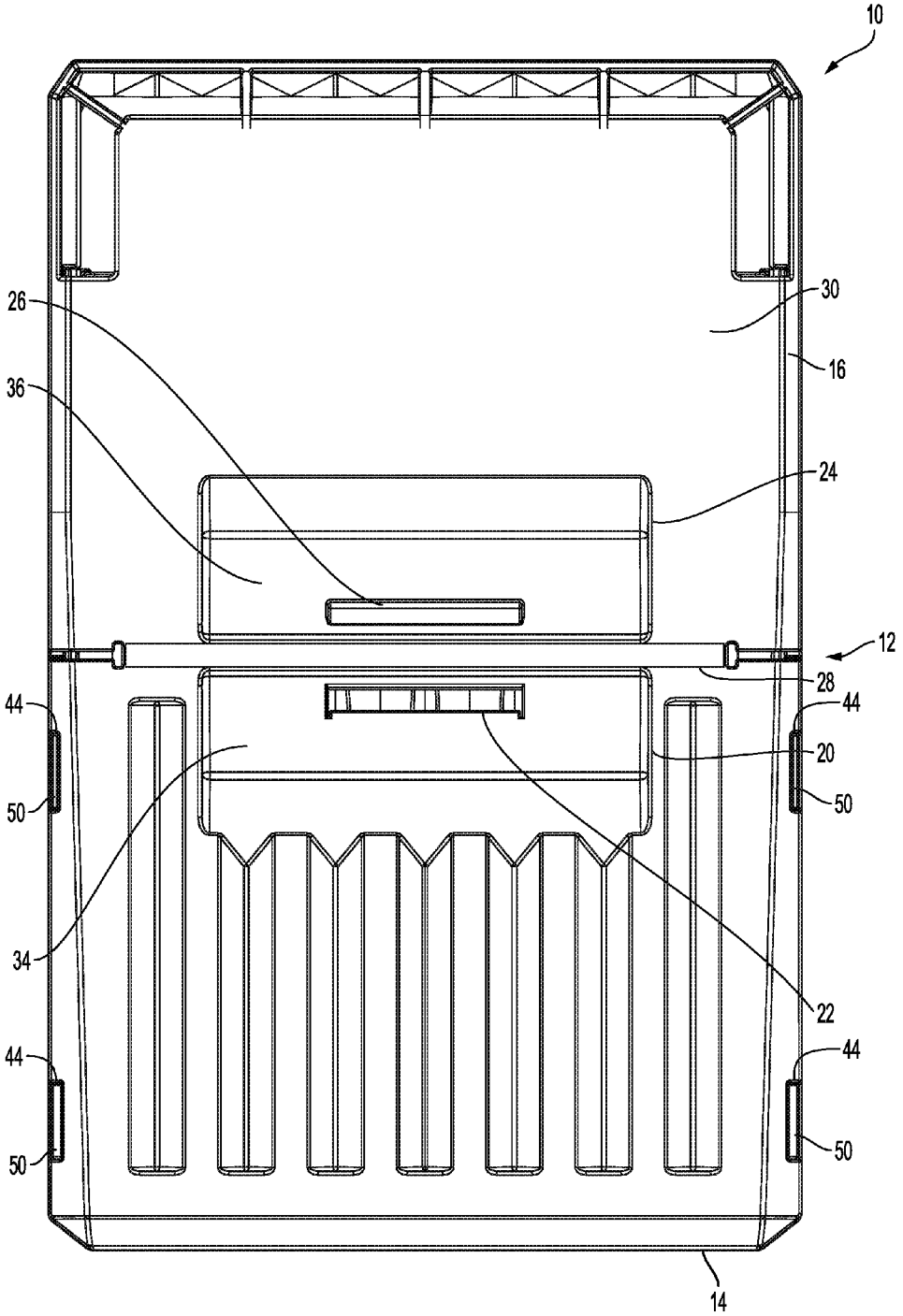
FIG. 5 is a rear view of the writing instrument case of FIG. 1.

Referring back to FIG. 3, the first member 14 of the base 12 can also include a pair of side walls 42, each of which includes at least one opening 44. The side walls 46 of the flap 18 can further include at least one tab 50 that is adapted to fit within the at least one opening 44 of the first member 14 of the base 12 to form a permanent attachment between the flap 18 and the first member 12. In one example, and as also depicted in FIG. 5, a lower section of each side wall 46 includes two equally spaced tabs 50 that fit within two corresponding openings 44 of the first member 12, providing the permanent attachment between the first member 14 of the base 12 and the flap 18. Said another way, the lower portion of the flap 18 is permanently attached to the first member 14 via the tabs 50 of the flap 18 that fit into the openings 44 of the first member.

Figure 6:
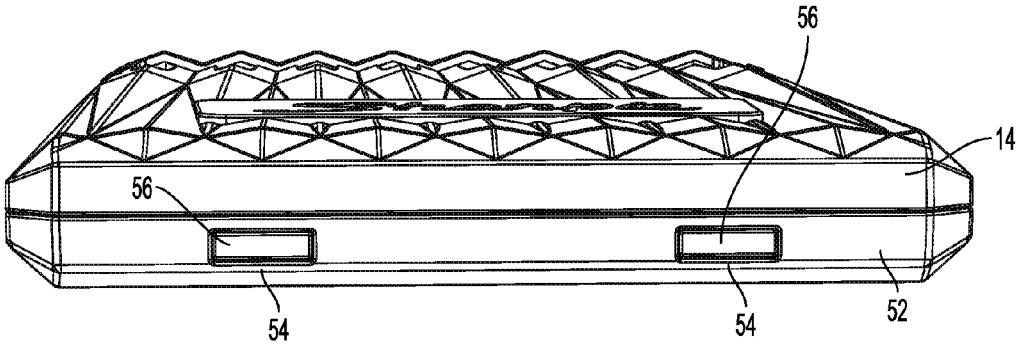
FIG. 6 is a bottom perspective view of the writing instrument case of FIG. 1.
Figure 23:
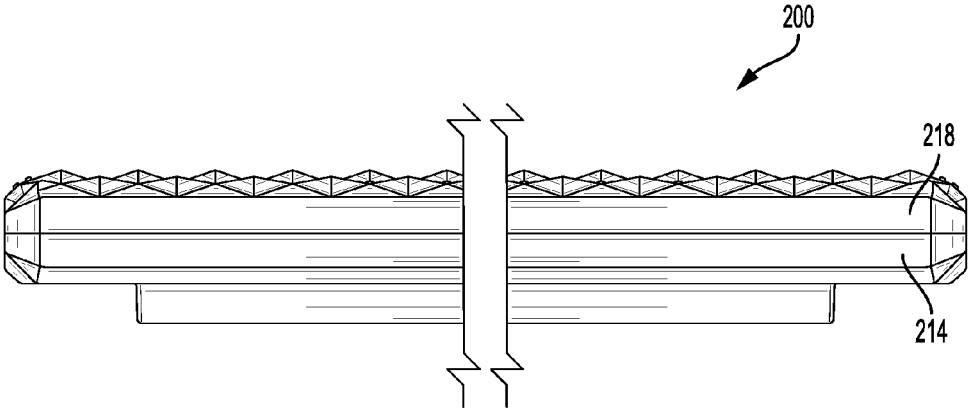
FIG. 23 is a bottom view of the writing instrument case of FIG. 17.

In a similar manner, and referring now to FIG. 6, in various embodiments, the first member 14 also includes a bottom portion 52 having at least one opening 54. In one example, the bottom portion 52 includes two openings 54, although fewer or more openings 54 may alternatively and/or additionally be included and still fall within the scope of the present disclosure. FIG. 23, for example, illustrates an embodiment having no openings. The flap 18 includes at least one tab 56 that fits into the openings 54 on the bottom portion 52 of the first member 14 to further permanently attach the flap 18 to the first member 14 of the base 12. Said another way, the tabs 56 of the flap 18 snap into the openings 54 on the bottom portion 52 of the first member 14 of the base 12. While the openings 54 are illustrated as rectangular in shape in FIG. 5, one of ordinary skill in the art will appreciate that the openings and corresponding tabs 56 can alternatively and/or additionally take the form of various other shapes and still fall within the scope of the present disclosure.

Figure 7:
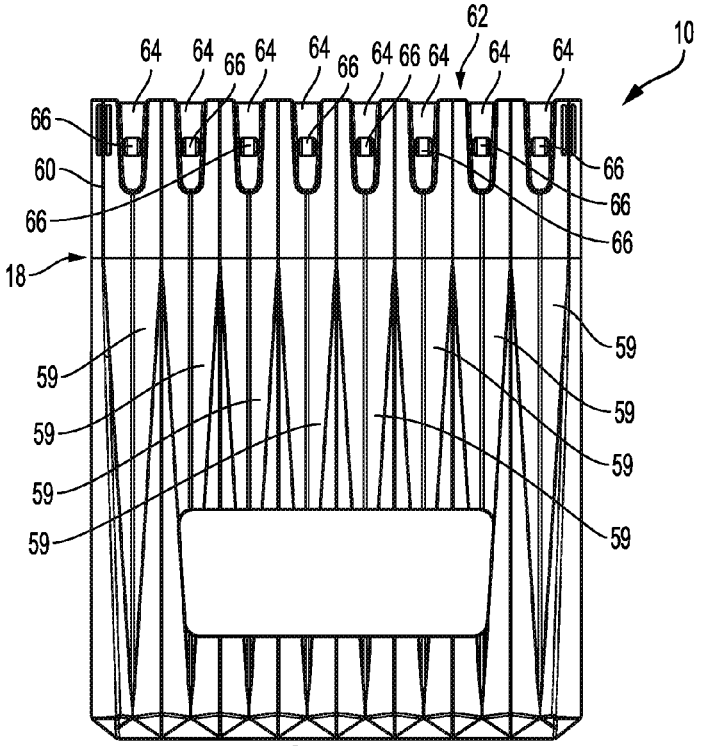
FIG. 7 is a front view of the writing instrument case of FIG. 1, the writing instrument case in an easel position.
Figure 8:
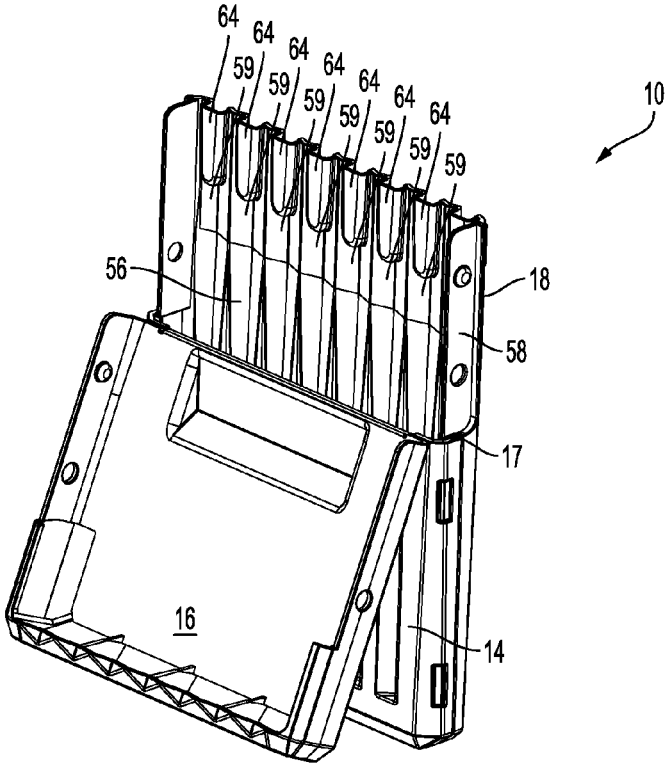
FIG. 8 is a rear perspective view of the writing instrument case of FIG. 7.

Referring now to FIGS. 7-10, the case 10 is depicted in an easel position. More specifically, in each of FIGS. 7-10, the second member 16 is in an open position, in which the second member 16 engages the first member 14 after rotation of the second member 16 about the hinge 17 in a clockwise direction toward the first member 14 to create the easel position. As depicted, for example, in FIG. 8, in various embodiments, the flap 18 further includes an inside surface 56 having a plurality of channels 58 adapted to receive at least one writing instrument (not shown). At least one channel 59 of the plurality of channels 58 has a diameter that decreases along the length of the channel 59, as illustrated in FIG. 7. Said another way, the diameter of the at least one channel 59 is a first value at or near the second member 16 of the base 12 and a second value less that the first value at or near the first member 14 of the base 12. As a result, the diameter of the channel 59 decreases from an area near the second member 16 to an area near the first member 14.

Figure 9:
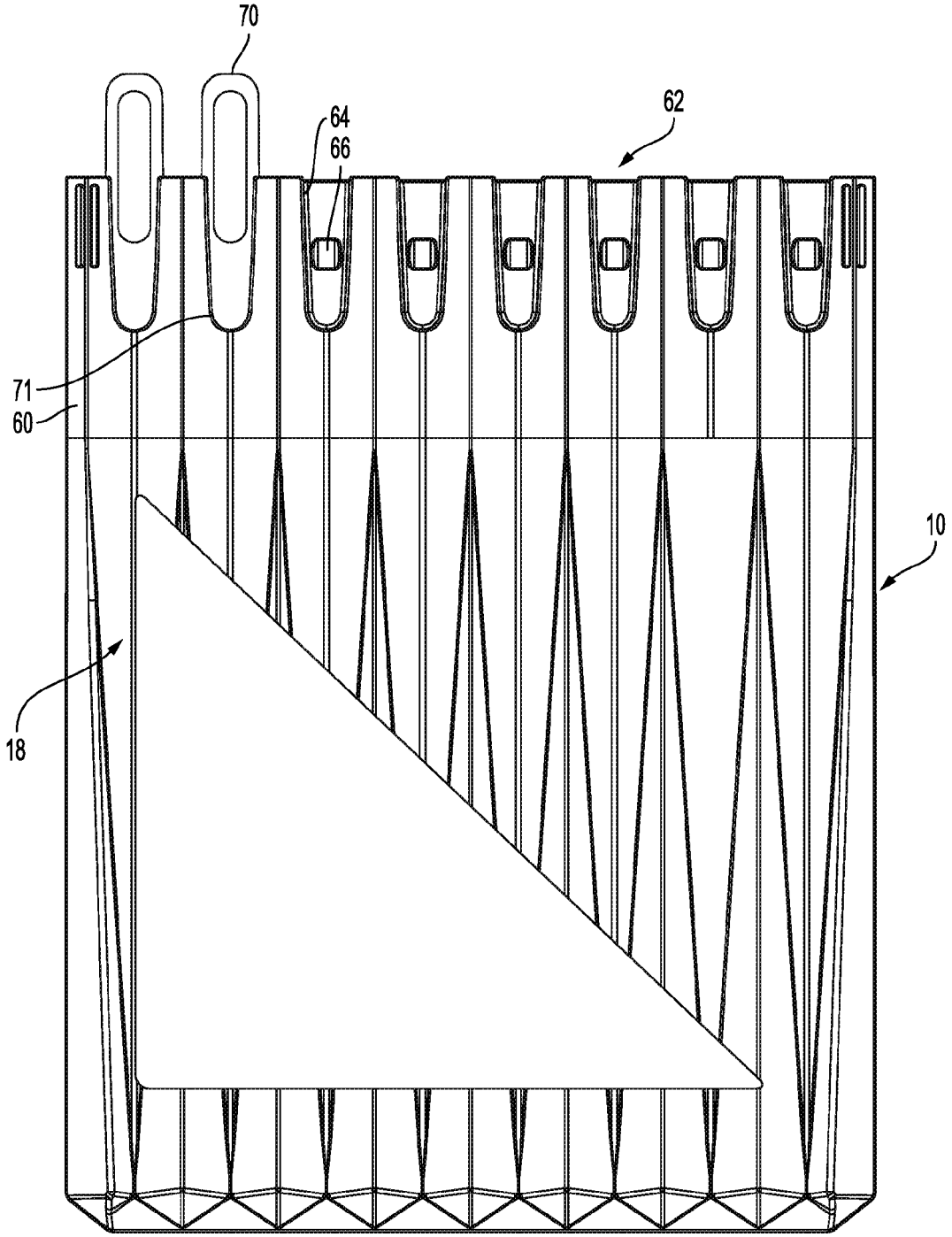
FIG. 9 is a front perspective view of the writing instrument case of FIG. 7 having at least one writing instrument disposed within the case.

Referring to FIG. 7, in embodiments, the flap 18 further includes an outside surface 60 having a plurality of grooves 62 aligned with the plurality of channels 58. At least one groove 64 of the plurality of grooves 62 includes a knob 66. The at least one groove 64 is adapted to receive a portion of a writing instrument 70, such as cap 71, as depicted in FIG. 9. The knob 66 further prevents the portion of the writing instrument 70 from detaching from the groove 64. As a result, the intended position of each writing instrument 70 within the channel 59 of the plurality of channels 58 can be maintained in virtually any orientation of the case 10.

Figure 10:
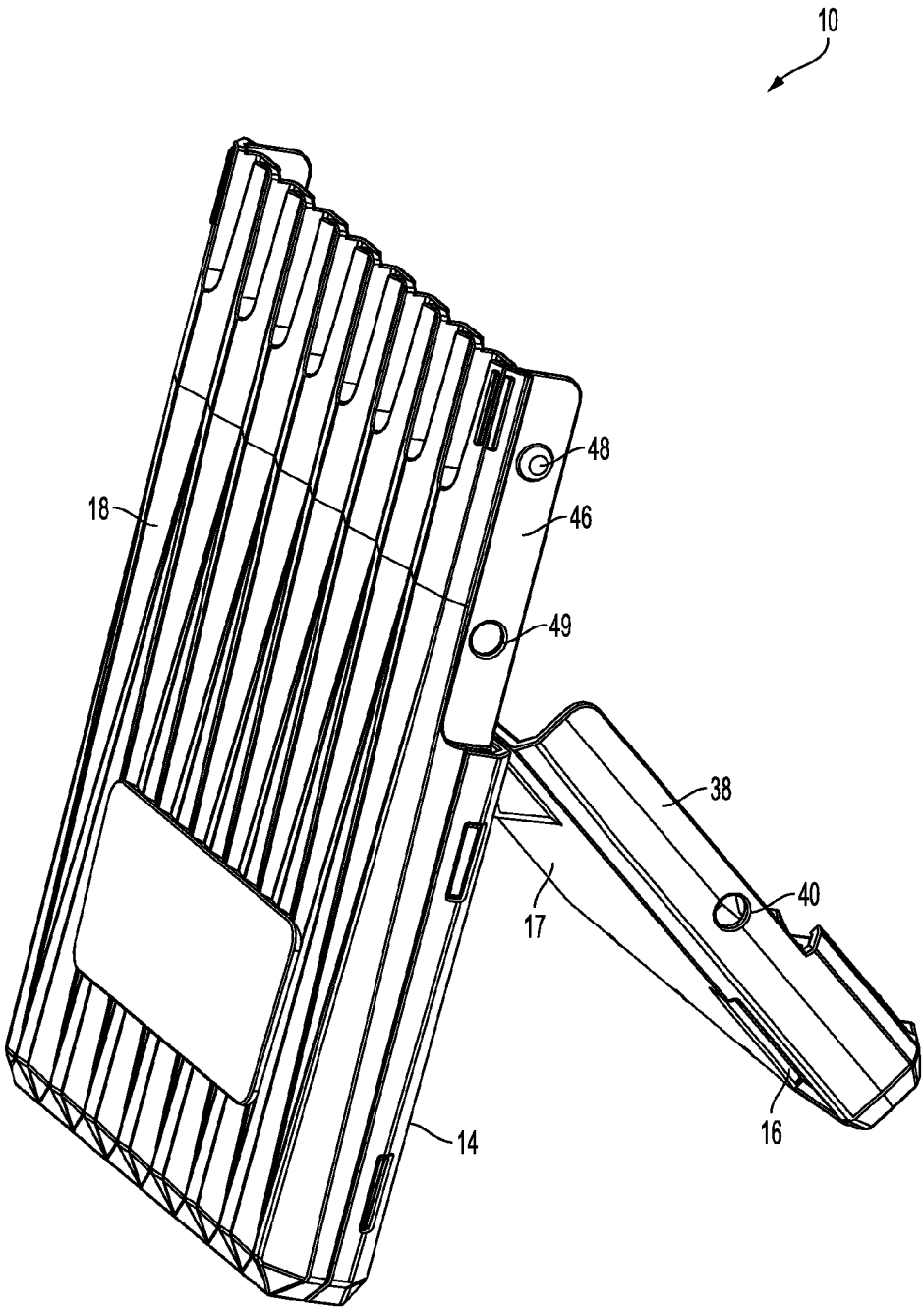
FIG. 10 is a side perspective view of the writing instrument case of FIG. 7.

The second member 16 of the base 12 is rotatably moveable about the hinge 17 between a closed position, which is depicted in FIG. 2, for example, and an open position. As noted, in the closed position, the at least one button 48 of the flap 18 is disposed within the dimple 40 of the second member 16 of the base 12. Upon rotation of the second member 16 in a clockwise direction toward the first member 14 of the base 12, however, the second member 16 is removed from the flap 18, as depicted in FIG. 10, for example. In particular, the at least one button 48 of the flap 18 disengages from the dimple 40 of the second member 16 upon rotational movement of the second member 16 about the hinge 17.

Figure 11:
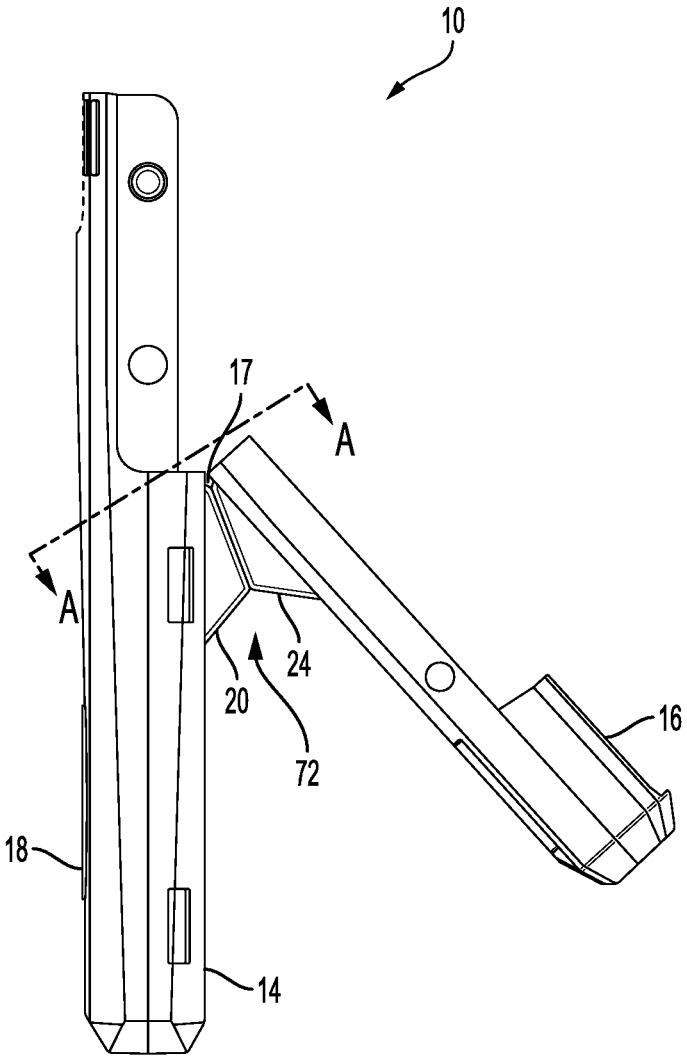
FIG. 11 is a side view of the writing instrument case of FIG. 7.
Figure 12:
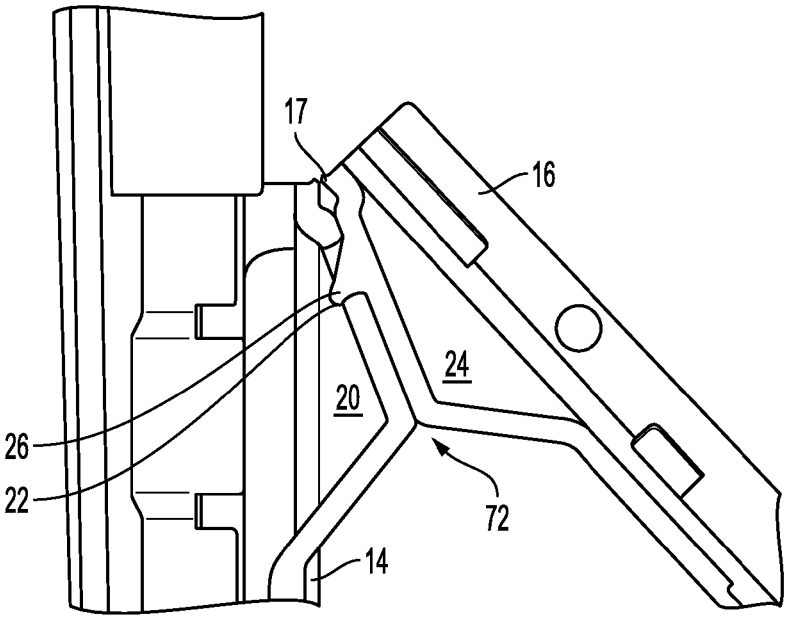
FIG. 12 is a sectional view of a portion the writing instrument case taken along the lines A-A of FIG. 11.
Figure 13:
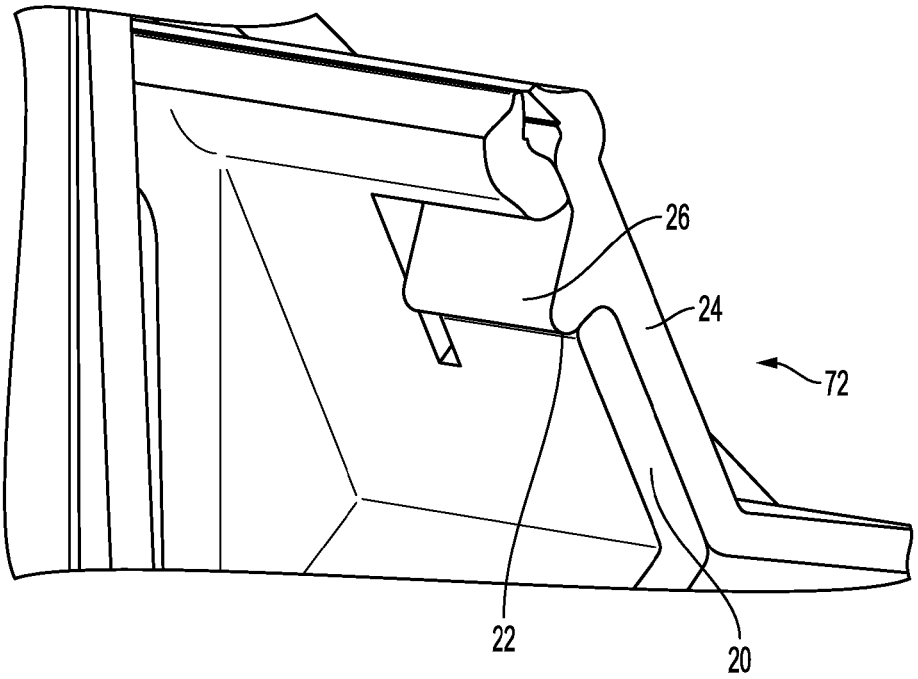
FIG. 13 is close up, perspective sectional view of the writing instrument case of FIG. 12.

Referring now to FIGS. 11-13, the second member 16 is further rotated about the hinge 17 until the projection 26 of the second member 16 fits into the slot 22 of the first member 14 of the base 12, forming the locking mechanism 72. Said another way, the projection 26 of the second member 16 and the slot 22 of the first member 14 together form the locking mechanism 72 when the second member 16 is rotated about the hinge 17 to an open position, such as an easel position. As a result, the easel position is locked in place by way of the locking mechanism 72 without any writing instrument needed. In addition, and as further depicted in FIGS. 11 and 12, the wedges 20, 24 of the first member 14 and second member 16, respectively, of the base 12 contact each other in the easel position to help align the projection 26 of the wedge 24 with the slot 22 of the wedge 20.

In various embodiments, the features of the case can enhance the moldability of the case, which can allow for easier and/or more efficient manufacturing. For example, the molds for forming the case of embodiments of the disclosure can be formed without the addition of undercuts, which can complicate the mold design. In addition, during manufacturing via a molding process, improved manufacturability can be achieved by the fact that the mold base can be pulled in an upward direction when molding the base part.

Further, as is appreciated from the foregoing description, in various embodiments, the case 10 can include only three molded parts with the various foregoing features, which can also allow for easier and/or more efficient manufacturing. More specifically, the three parts of the case 10 include: (1) the two-piece base 12 including the first member 14 and the second member 16 rotatably attached to the first member 14; and (2) the single piece flap 18. In accordance with an embodiment of the disclosure, the base 12 and/or the flap 18 can be formed of or include one or more of a polymer, a homopolymer, a plastic, or any other rigid material having a strength and thickness to support the at least one writing instrument in the easel position. For example, in an embodiment the base and/or the flap can be formed of polypropylene. In one example, the first and second members 14, 16 of the base 12 are made of a polypropylene homopolymer material. The case can be formed of the same material or have parts formed of different materials. For example, the base can be formed of a first material, and the flap can be formed of a second, different material. In yet another exemplary embodiment, the base having two-pieces can have each piece formed of a different material, with the flap formed of the same or a different material as the base pieces.

Figure 15:
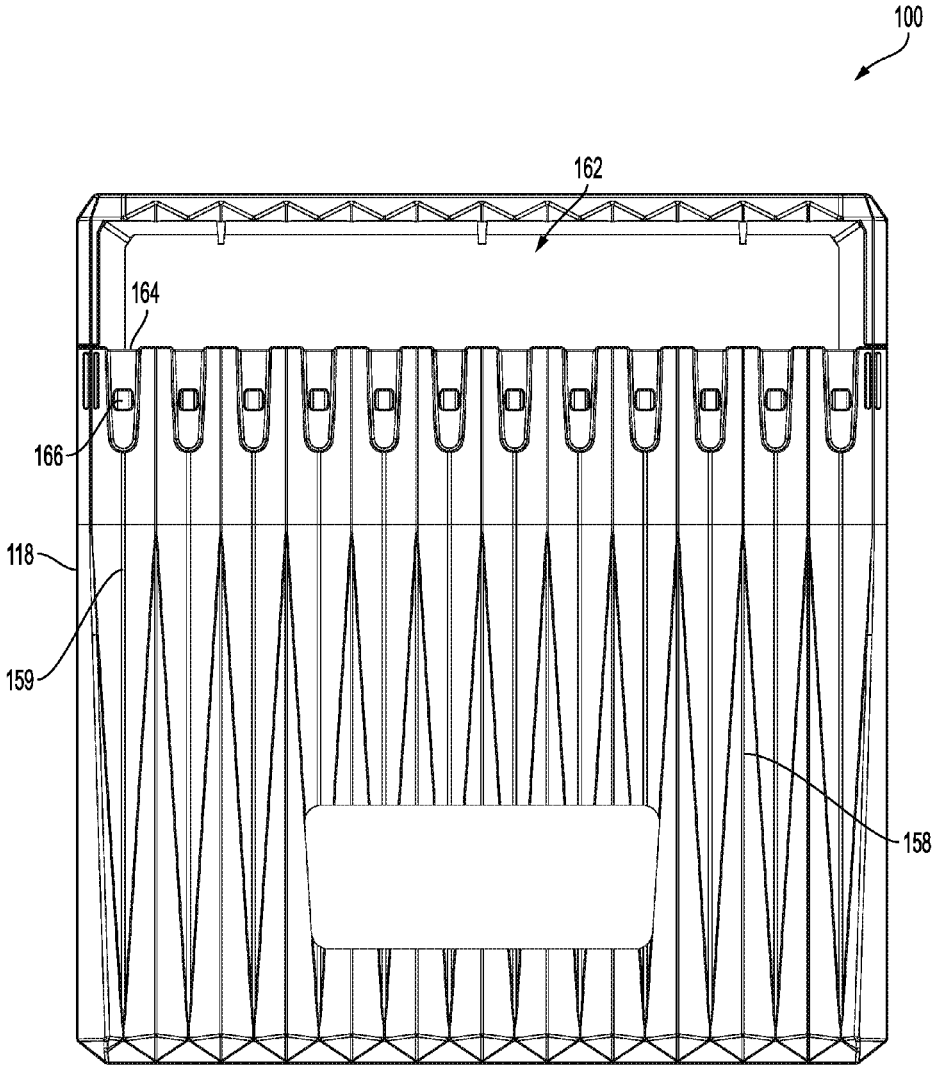
FIG. 15 is a front view of the writing instrument case of FIG. 14.
Figure 16:
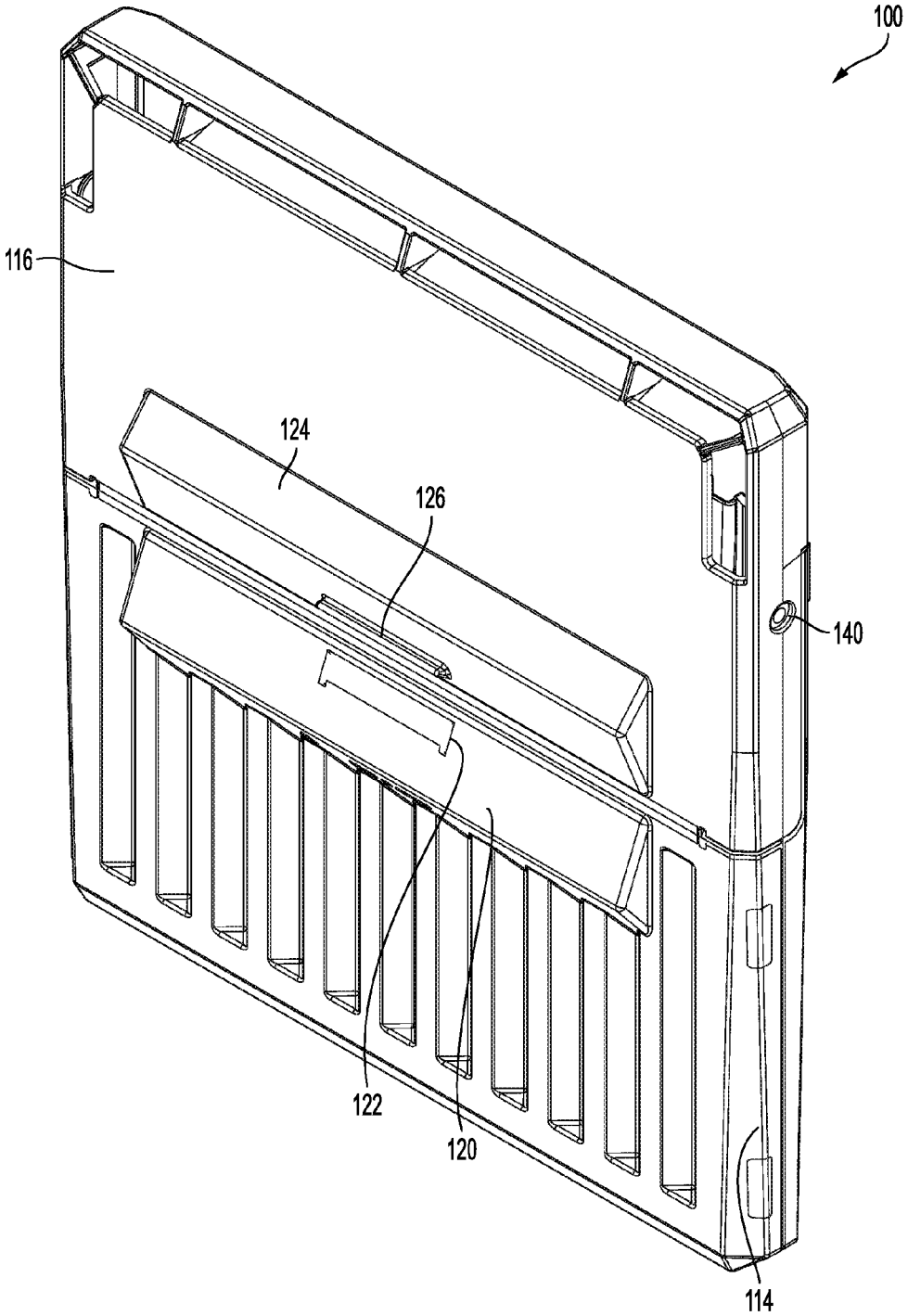
FIG. 16 is a rear perspective view of the writing instrument case of FIG. 14.

Referring now to FIGS. 14-16, another exemplary writing instrument case 100 of the present disclosure is depicted in a closed position. The writing instrument case 10 depicted FIGS. 1-13 is an 8 count case, meaning the case is adapted to hold 8 writing instruments. Cases in accordance with the disclosure can be designed to hold any suitable number of writing instruments. The writing instrument case 100 of FIGS. 14-16 functions to convert from a closed to an open, easel position, as described above for the writing instrument case 10, except the writing instrument case 100 is a 12 count case, meaning the case is adapted to hold 12 writing instruments. As noted above, cases capable of holding other numbers of writing instruments still fall within the scope of the present disclosure. In FIGS. 14-16, elements of the writing instrument case 100 that are identical to or the same as elements of the writing instrument case 10 of FIGS. 1-13 have reference numbers 100 greater than the reference numbers of the writing instrument case 10.

For example, and more specifically, FIG. 14 depicts the writing instrument case 100 having a base 112 with a first member 114 and a second member 116 rotatably attached to the first member 114 via a living hinge 117. A flap 118 is attached to the base 112 in the same manner the flap 18 is attached to the base 12 of the writing instrument case 10 and includes all the same structural features of the flap 18.

Like the writing instrument case 10, the second member 116 of the base 112 is rotatably moveable between a closed position, depicted in FIGS. 14-16, and an open position. While an open position is not depicted for the writing instrument case 100, the open and closed positions of the writing instrument case 100 are the same as the open and closed positions of the writing instrument case 10. More specifically, in the depicted embodiment, the closed position is a position in which at least one button 148 of the flap 118 is disposed within at least one dimple 140 of the second member 116, for example. The open position, such as an easel position, is a position in which the at least one button 148 of the flap 118 is removed from the at least one dimple 140 of the second member 116 due to rotational movement of the second member 116 about the hinge 117 in a direction toward the first member 114 of the base 112. In addition, the projection 126 of the second member 116 fits into the slot 122 of the first member 114 of the base 112, forming a locking mechanism between the first and second members 114, 116, and creating a locked easel position.

In addition, as described above for the writing instrument case 10, the flap 118 of the writing instrument case 100 can include a plurality of channels 158 and a plurality of grooves 162 that are aligned with the plurality of channels 158, as depicted in FIG. 15, for example. At least one groove 164 of the plurality of grooves 162 includes a knob 166 and is adapted to receive a portion, such as a cap, of a writing instrument. Together, the grooves 164 and the knob 166 maintain an intended position of at least one writing instrument, such that the case 100 can be turned upside down or put into any other orientation without any writing instrument falling out of the case 100.

Referring now to FIGS. 17-30, another exemplary writing instrument case 200 is depicted. The writing instrument case 10 depicted in FIGS. 1-13 is an 8 count case, meaning the case is adapted to hold 8 writing instruments, and the writing instrument case 100 of FIGS. 14-16 is a 12 count case, meaning the case is adapted to hold 12 writing instruments. Like the writing instrument case 100 of FIGS. 14-16, the writing instrument case 200 of FIGS. 17-30 also is a 12 count case or adapted to hold 12 writing instruments. In FIGS. 17-30, elements of the writing instrument case 200 that are identical to or the same as elements of the writing instrument case 10 of FIGS. 1-13 have reference numbers 200 greater than the reference numbers of the writing instrument case 10 and 100 greater than the reference numbers of the writing instrument case 100 of FIGS. 14-16.

For example, and more specifically, FIGS. 17-21 depict the writing instrument case 200 having a base 212 with a first member 214 and a second member 216 rotatably attached to the first member 214 via a living hinge 217. A flap 218 is attached to the base 212 in the same manner the flap 18 is attached to the base 12 of the writing instrument case 10 and includes all the same structural features of the flap 18 of FIGS. 1-13.

Like the writing instrument cases 10 and 100, the second member 216 of the base 212 is rotatably moveable between a closed position, depicted in FIGS. 17-23, and an open position, e.g., an easel position, depicted in FIGS. 24-30, for example. The open and closed positions of the writing instrument case 200 are the same as the open and closed positions of the writing instrument case 10. More specifically, in the depicted embodiment, the closed position is a position in which at least one button 248 (e.g., FIG. 20) of the flap 218 is disposed within at least one dimple 240 (e.g., FIG. 20) of the second member 216, for example. The open position, such as an easel position, is a position in which the at least one button 248 of the flap 218 is removed from the at least one dimple 240 of the second member 216 due to rotational movement of the second member 216 about the hinge 217 in a direction toward the first member 214 of the base 212. In addition, a projection 226 of the second member 116 fits into a portion, such as a receiving portion 222 (FIG. 19) of the first member 214 of the base 212, forming a locking mechanism 272 (FIG. 27A) between the first and second members 214, 216, and creating a locked easel position.

Figure 24:
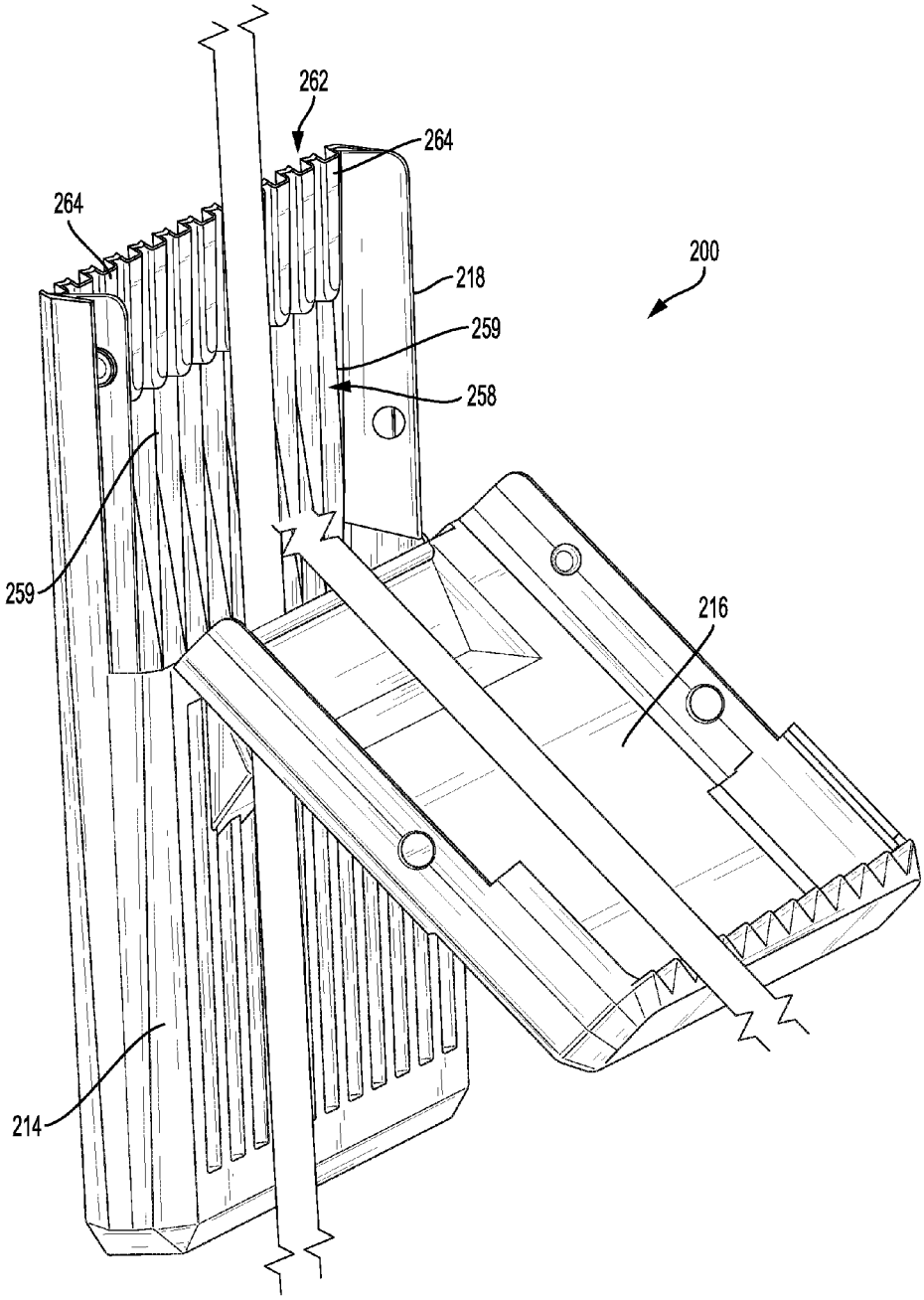
FIG. 24 is a rear perspective view of the writing instrument case of FIG. 17, with the writing instrument case in the easel position.
Figure 25:
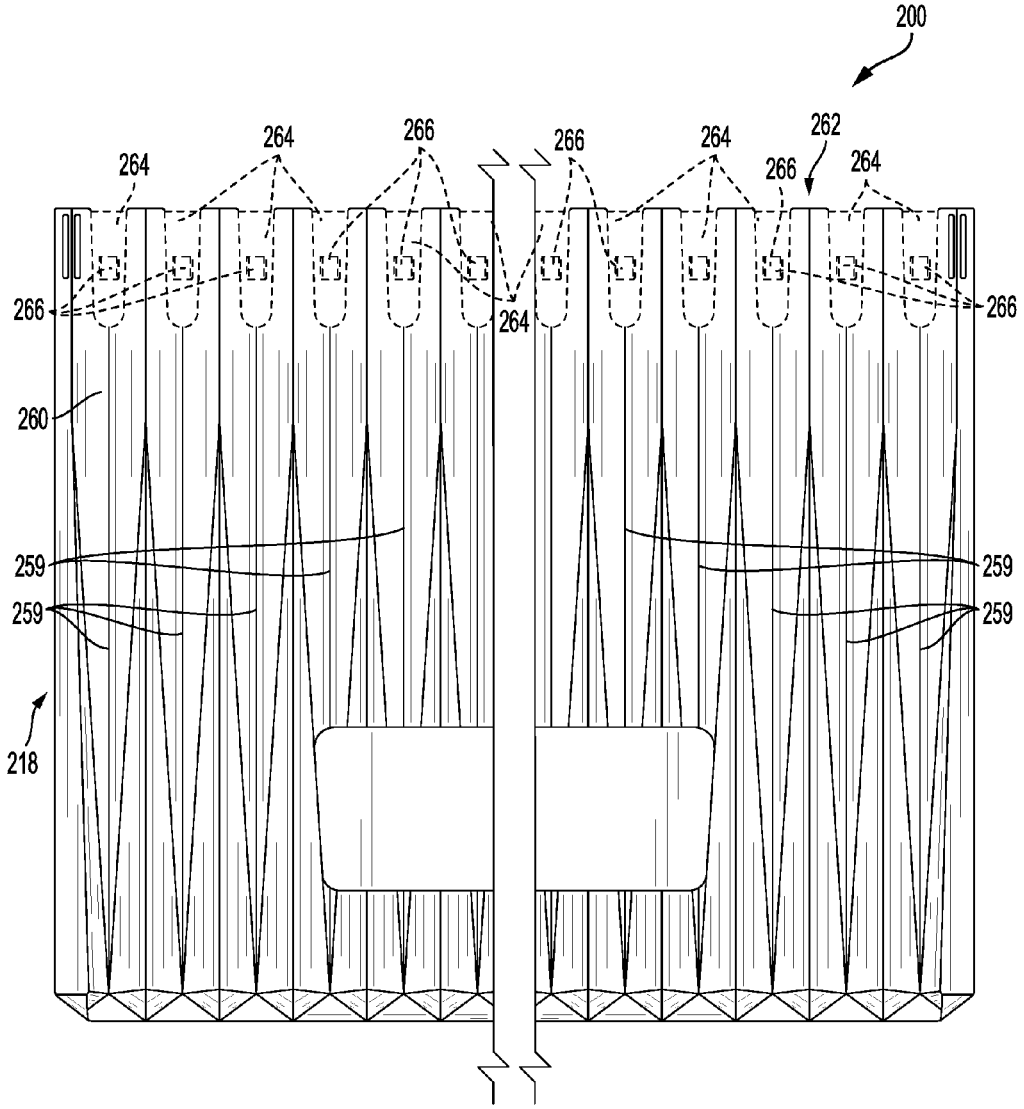
FIG. 25 is a front view of the writing instrument case of FIG. 24.
Figure 26:
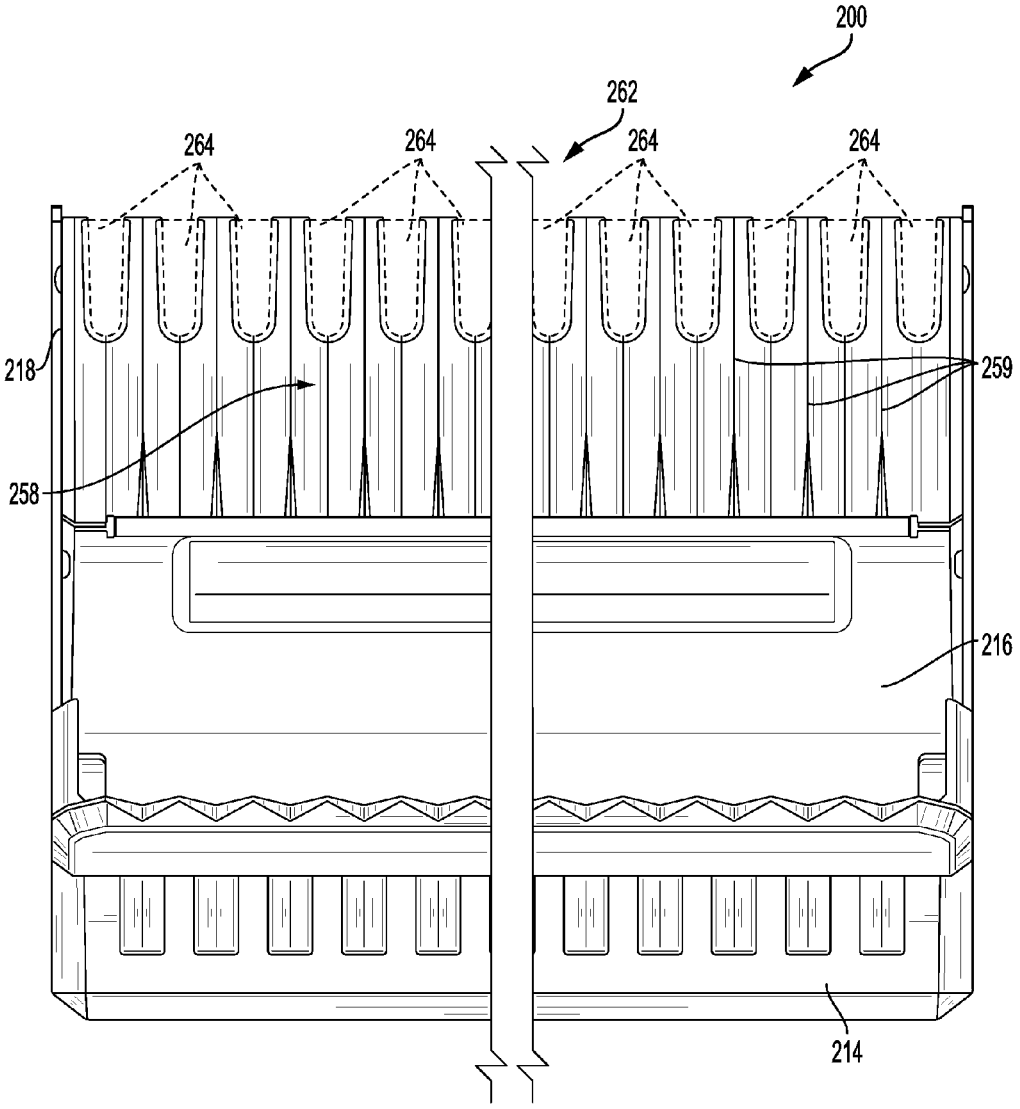
FIG. 26 is a rear view of the writing instrument case of FIG. 24.

Further, and as described above for the writing instrument case 10, the flap 218 of the writing instrument case 200 can include a plurality of channels 258 and a plurality of grooves 262 that are aligned with the plurality of channels 258, as depicted in FIGS. 24-26, for example. At least one groove 264 of the plurality of grooves 262 includes a knob 266 and is adapted to receive a portion, such as a cap, of a writing instrument. Together, the grooves 264 and the knob 266 maintain an intended position of at least one writing instrument, such that the case 200 can be turned upside down or put into any other orientation without any writing instrument falling out of the case 200.

Figure 27A:
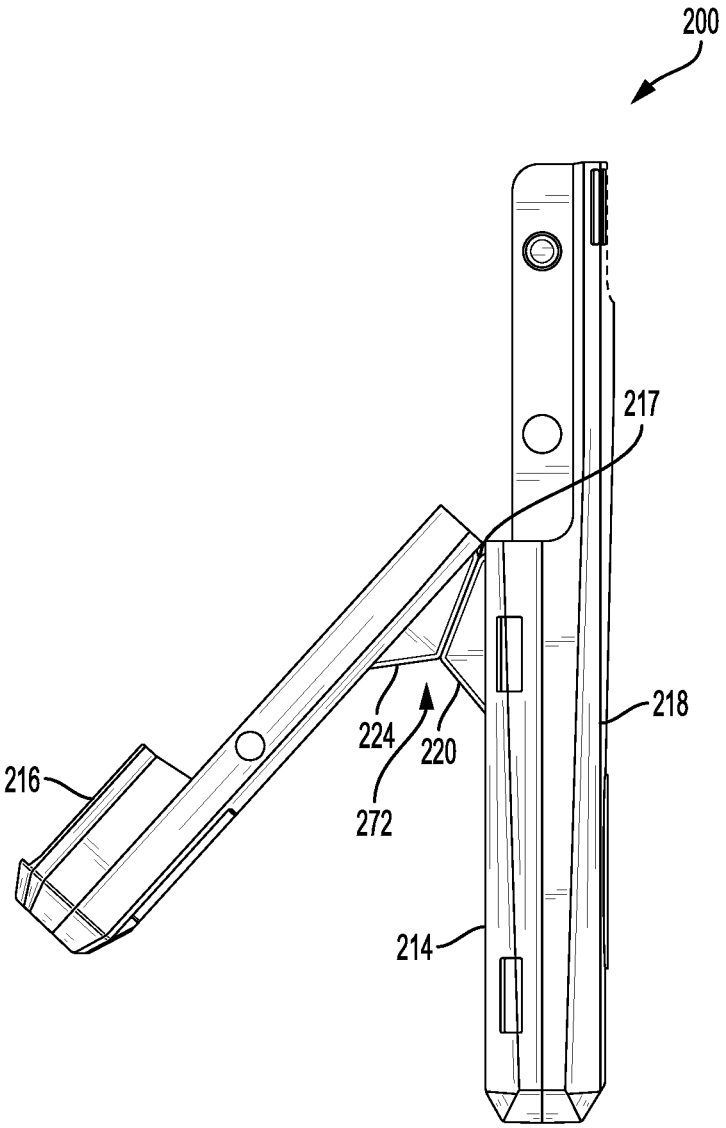
FIGS. 27A and 27B are side views of the writing instrument case of FIG. 24.
Figure 27B:
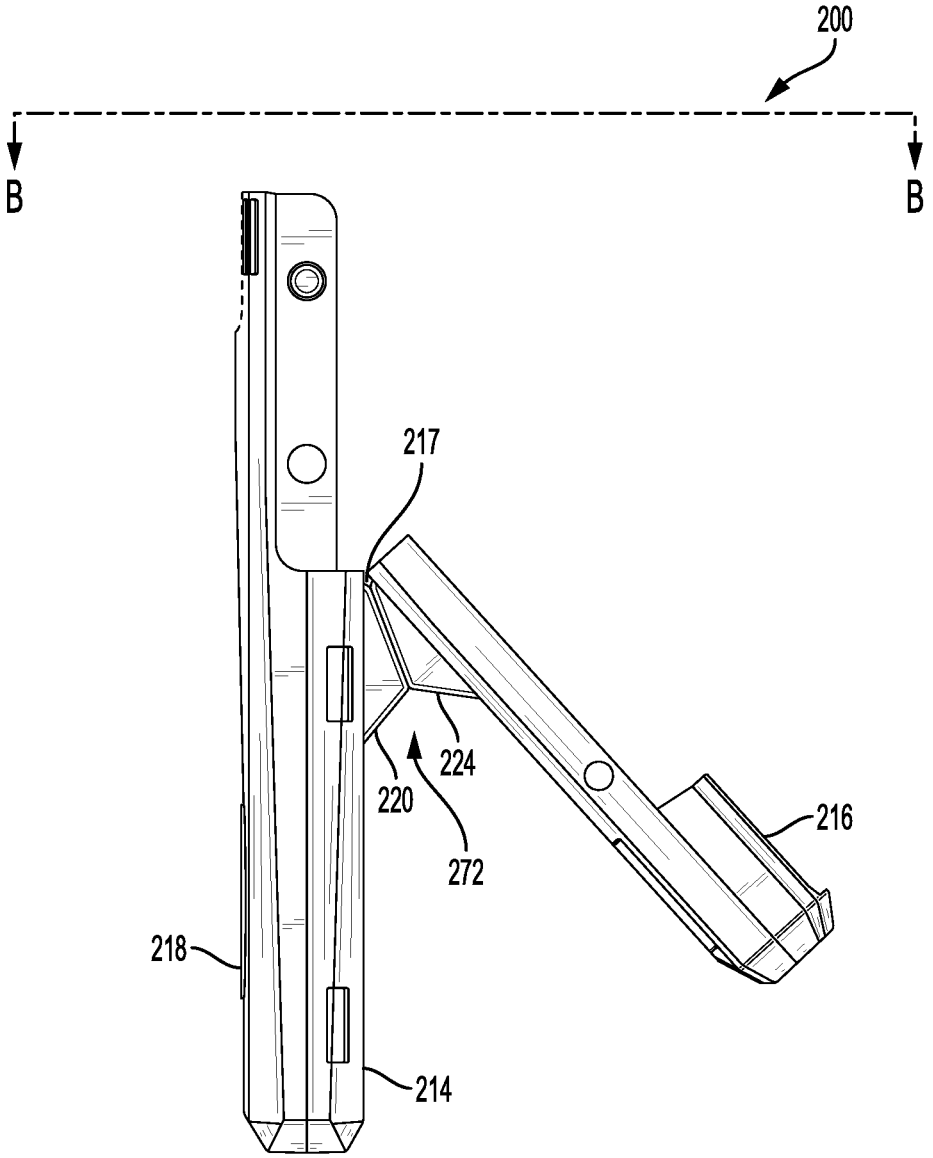
Figure 28:
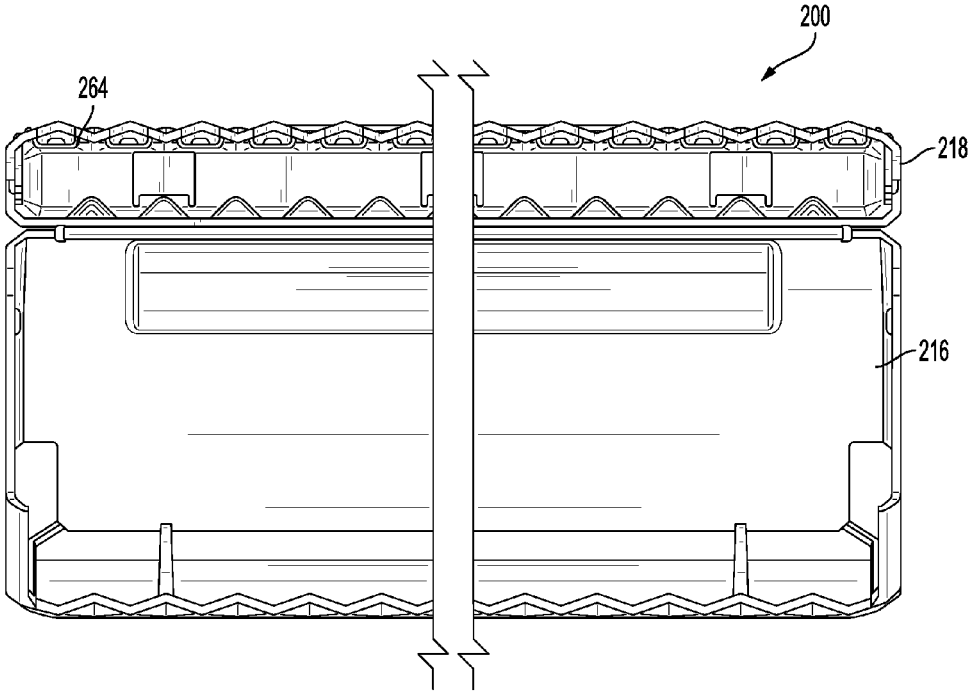
FIG. 28 is a top view of the writing instrument case of FIG. 24.
Figure 29:
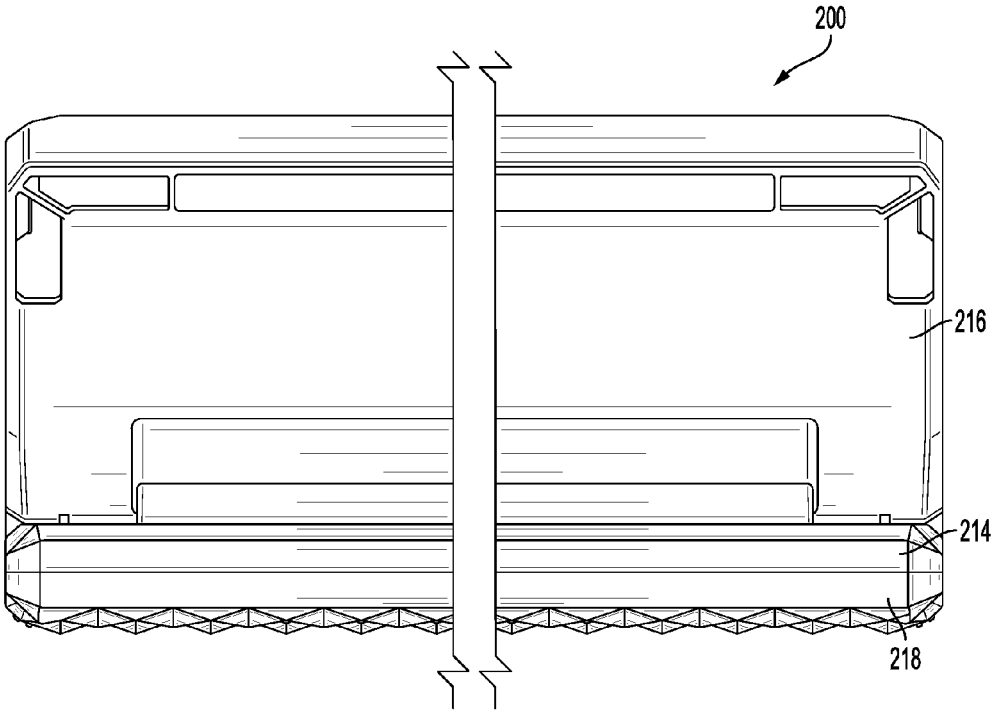
FIG. 29 is a bottom view of the writing instrument case of FIG. 24.
Figure 30:
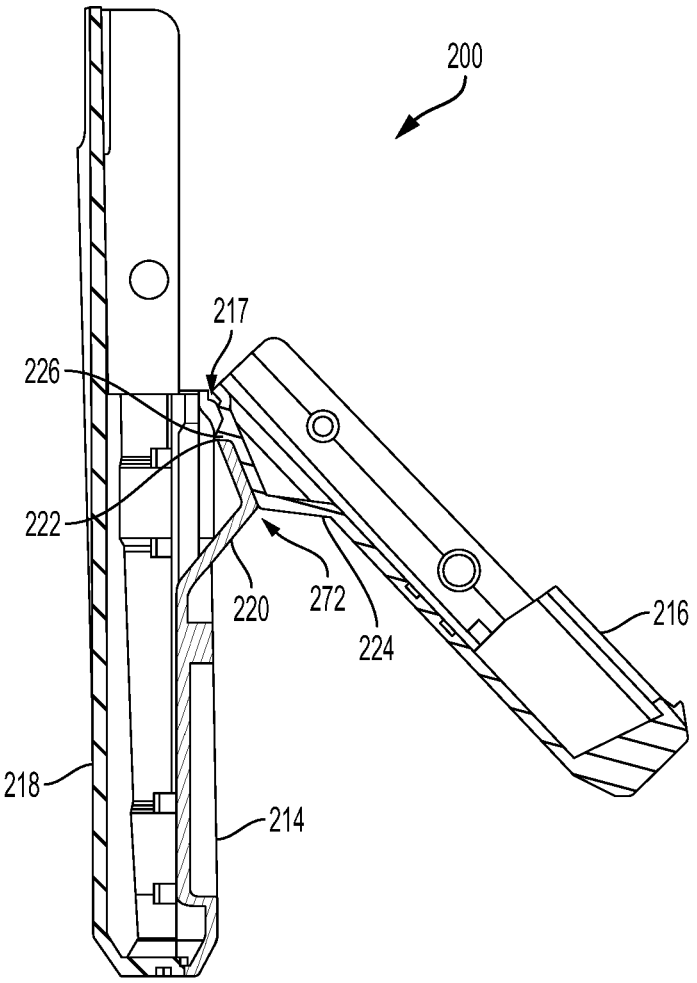
FIG. 30 is a sectional view the writing instrument, taken along the lines B-B of FIG. 27B.

As depicted in FIGS. 27A, 27B and 30, for example, and similar to the writing instrument cases 10 and 100, the second member 216 is rotated about the hinge 217 until a wedge 224 of the second member 216 contacts a wedge 220 of the first member 214 to form a locking mechanism 272. More specifically, the wedge 224 includes the projection 226, and the wedge 220 includes the receiving portion 222, such as a slot. Thus, when the second member 216 is rotated about the hinge 217, the projection 226 of the wedge 224 of the second member 216 fits into the slot 222 of the wedge 220 of the first member 214 of the base 212, forming the locking mechanism 272. Said another way, the projection 226 of the wedge 224 of the second member 216 and the slot 222 of the wedge 220 of the first member 214 together form the locking mechanism 272 when the second member 216 is rotated about the hinge 217 to an open position, such as an easel position. As a result, the easel position is locked in place by way of the locking mechanism 272 without any writing instrument needed. In addition, the wedges 220, 224 of the first member 214 and second member 216, respectively, of the base 212 contact each other in the easel position to help align the projection 226 of the wedge 224 with the slot 222 of the wedge 220.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

As used herein any reference to "one example" or "an example" means that a particular element, feature, structure, or characteristic described in connection with the embodiment is included in at least one embodiment. The appearances of the phrase "in one example" in various places in the specification are not necessarily all referring to the same example.

Some examples may be described using the expression "coupled" and "connected" along with their derivatives. For example, some examples may be described using the term "coupled" to indicate that two or more elements are in direct physical or electrical contact. The term "coupled," however, may also mean that two or more elements are not in direct contact with each other, but yet still cooperate or interact with each other. The examples are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the description. This description, and the claims that follow, should be read to include one or at least one and the singular also includes the plural unless it is obvious that it is meant otherwise.

This detailed description is to be construed as examples and does not describe every possible embodiment, as describing every possible embodiment would be impractical, if not impossible. One could implement numerous alternate embodiments, using either current technology or technology developed after the filing date of this application.

What is claimed:

1. An instrument case comprising:

a base with a first member and a second member rotatably attached to the first member via a living hinge, the first member having a rear surface with a slot, and the second member having at least one dimple and a rear surface with a projection adapted to fit within the slot of the first member upon rotation of the second member in a direction toward the first member;

a flap attached to the base, the flap including at least one button adapted to fit within the at least one dimple of the second member, an inside surface having a plurality of channels adapted to receive at least one writing instrument, and an outside surface having a plurality of grooves aligned with the plurality of channels, one or more of the plurality of grooves being adapted to receive a portion of a cap of the at least one writing instrument, each of the one or more grooves having a knob;

wherein the second member of the base is rotatably moveable between a closed position, in which the at least one button of the flap is disposed within the at least one dimple of the second member, and an open position, in which the at least one button is removed from the at least one dimple of the second member and the second member is rotated about the hinge until the projection of the second member fits within the slot of the first member of the base, forming a locking mechanism between the first and second members and creating a locked easel position.

2. The case of claim 1, wherein the rear surface of the first member of the base further includes a wedge, and the slot is disposed in the wedge.

3. The case of claim 2, wherein the rear surface of the second member of the base further includes a wedge having a geometric configuration that matches a geometric configuration of the wedge of the first member of the base, the projection disposed on the wedge of the second member.

4. The case of claim 3, wherein, when the second member of the base is in the open position, a surface of the wedge of the first member contacts a surface of the wedge of the second member and the projection of the second member fits into the slot of the first member to form the locking mechanism of the easel position.

5. The case of claim 1, wherein the second member of the base includes a pair of side walls, each side wall of the pair of side walls including a dimple adapted to receive a button of the flap.

6. The case of claim 1, wherein the first member of the base includes a pair of side walls and a bottom portion, each of the side walls and bottom portion having at least one opening for receiving at least one tab of the flap to permanently attach the flap to the first member of the base.

7. The case of claim 1, wherein the flap further includes a pair of side walls and a bottom portion, each of the side walls and the bottom portion having at least one tab adapted to fit within at least one opening of the first member of the base.

8. The case of claim 1, wherein the flap further includes a pair of side walls, each side wall of the pair of side walls including at least one button adapted to be removeably inserted into the at least one dimple of the second member.

9. The case of claim 1, wherein the plurality of channels of the inside surface of the flap include at least one channel having a diameter decreasing along the length of the at least one channel.

10. The case of claim 1, wherein each groove of the plurality of grooves disposed on the outside surface of the flap includes a knob to secure the writing instrument to the flap.

11. The case of claim 1, wherein the second member is rotated in a clockwise direction about the hinge until the projection of the second member fits into the slot of the first member of the base to form the locking mechanism.

12. The case of claim 1, wherein one or more of the base and the flap comprises one or more of a polymer, a homopolymer, and a plastic.

13. The case of claim 12, wherein one or more of the base and the flap comprises a polypropylene homopolymer.

14. A writing instrument case comprising:

a base with a first member and a second member rotatably attached to the first member via a hinge, the first member having a receiving portion, and the second member having a projecting portion adapted to be inserted into the receiving portion;

a flap permanently attached to the first member of the base, the flap having one or more grooves adapted to receive a portion of at least one writing instrument, each of the one or more grooves having a knob;

wherein the second member of the base is rotatably moveable between a closed position, in which the second member engages a portion of the flap, and an easel position, in which the second member is removed from the portion of the flap and rotated about the hinge until the projecting portion of the second member fits within the receiving portion of the first member of the base, forming a locking mechanism between the first and second members.

15. The case of claim 14, wherein the receiving portion is one or more of an aperture, a slot, or an opening disposed within a rear surface of the first member.

16. The case of claim 14, wherein the projecting portion is at least one projection extending from a rear surface of the second member.

17. The case of claim 14, wherein the second member of the base includes a pair of side walls, each side wall having a dimple, and wherein the flap includes a pair of side walls, each side wall of the flap having a button adapted to fit within the respective dimple of the side wall of the base when the second member is in the closed position.

18. The case of claim 14, wherein the flap further includes a bottom portion having at least one tab, and the first member of the base includes at least one opening for receiving the at least one tab of the flap to permanently attach the flap to the first member of the base.

19. The case of claim 14, wherein one or more of the base and the flap comprises one or more of a polymer, a homopolymer, and a plastic.

20. The case of claim 19, wherein one or more of the base and the flap comprises a polypropylene homopolymer.

* * * * *